US005210907A

United States Patent [19]

Toyama

[11] Patent Number: 5,210,907

[45] Date of Patent: May 18, 1993

[54] HINGE HAVING QUICKLY DETACHABLE PARTS

[75] Inventor: Hiroaki Toyama, Tokyo, Japan

[73] Assignee: Kabushiki Kaisha Murakoshi Seiko, Tokyo, Japan

[21] Appl. No.: 761,367

[22] PCT Filed: Dec. 21, 1990

[86] PCT No.: PCT/JP90/01671

§ 371 Date: Sep. 10, 1991

§ 102(e) Date: Sep. 10, 1991

[87] PCT Pub. No.: WO91/10031

PCT Pub. Date: Jul. 11, 1991

[30] Foreign Application Priority Data

Dec. 25, 1989 [JP] Japan ..... 1-336068
Sep. 1, 1990 [JP] Japan ..... 2-232001

[51] Int. Cl.[5] ..... E05D 7/10; E05D 11/00

[52] U.S. Cl. ..... 16/258; 16/251; 16/DIG. 43

[58] Field of Search ..... 16/258, 251, DIG. 43

[56] References Cited

U.S. PATENT DOCUMENTS 4,654,932 4/1987 Rock et al. ..... 16/258
4,680,830 7/1987 Rock et al. ..... 16/DIG. 43
4,750,238 6/1988 Rock et al. ..... 16/DIG. 43
4,847,948 7/1989 Gross et al. ..... 16/251
4,870,716 10/1989 Grass ..... 16/251
5,025,530 6/1991 Ferrari et al. ..... 16/258

FOREIGN PATENT DOCUMENTS 0237670 9/1987 European Pat. Off. .
0256376 2/1988 European Pat. Off. .
2736333 2/1979 Fed. Rep. of Germany .... 16/DIG. 43

*Primary Examiner*—Lowell A. Larson
*Assistant Examiner*—Carmine Cuda
*Attorney, Agent, or Firm*—Joseph C. Mason, Jr.; Ronald E. Smith

[57] ABSTRACT

A hinge used to attach a door of, for example, furniture in such a manner that the door can be opened and closed freely.

A base 1 is provided with stopper portion 15 to stop connecting member 2. Connecting member 2 is provided with connector 31 to be connected to hinge body 3 and clip 43 which has hooking portion 42 to be engaged with stopper portion 15 of base 1. Elastic member 43 or 125 to push clip 43 is provided between connector 31 and clip 43. Hinge body 3 can be attached through connecting member 2 to base 1 with a one-step operation.

Two stopper portions 15*a* and 15*b* or 92 and 95 are provided at the front and rear parts of base 1 respectively. Two hooking portions 42*a* and 42*b*, 123 and 124 or 135 and 139 are provided at the front and rear parts of connecting member 2 respectively. Moment generated from opening and closing of hinge body 3 is received by the front and rear hooking positions of base 1 and connecting member 2.

Hinge body 3 is provided with cover 150, 160 or 170 to cover operating portion 45 or 157 or clip 43 or 100. With this configuration, it is possible to prevent accidental operation of clip 43 or 100.

25 Claims, 13 Drawing Sheets

HINGE HAVING QUICKLY DETACHABLE PARTS

BACKGROUND OF THE INVENTION

1. Technical Field

This invention relates to hinges. More particularly, it relates to hinge constructions having utility in hingedly connecting a furniture door to an article of furniture.

2. Description of the Prior Art

Conventional hinges typically include a base which is fixedly secured to an object such as the side panel of an article of furniture. A hinge body is hingedly connected to a hinge cup, and the cup is fixedly secured to a door. The hinge body is usually connected through a plurality of link members to the body member. A connecting member is attached to the body member of the hinge body and is adapted for releasable engagement with the base.

Conventional hinges of this type are described in Japanese Patent Laid-Open No. 247679/1989.

The base is usually provided with a lip, which is integrally formed at a first end thereof, and a stop lever is formed at a second end thereof. A transversely disposed pin is positioned at a first end of the connecting member, and said pin is adapted to engage the lip of the base. The second end of the connecting member includes a hooking part for releasable engagement with the stop lever of the base.

To connect the hinge body to the base, the connecting member is fitted over the base by hooking the lip of the base with the transverse pin at the first end of the connecting member, and the hooking part at the second end of the connecting member is brought into engagement with the stop lever of the base. In this way, the hinge body is attached to the base and the connecting member is disposed in sandwiched relation therebetween.

The hinge body is removed from the base by reversing said procedure. The stop lever is displaced so that the second end of the connecting member is disengaged from the base body and the transverse pin is disengaged from the lip of the base by displacing the connecting member. Thus, the hinge body is removed from the base together with the connecting member.

In the hinge construction shown in said Japanese Patent Publication, to connect the connecting member to the base, the transverse pin at the first end of the connecting member is brought into engagement with a lip formed in the base; the stop lever of the base is then rotated to engage the hooking portion at the second end of the connecting member. That procedure is reversed to remove the hinge body from the base.

Those skilled in the art of hinge construction will appreciate that the above-described attachment and detachment operations are troublesome.

What is needed, then, is a hinge having a hinge body that is quickly and easily attachable to a base through a connecting member, thereby facilitating simple attachment and detachments of the hinge body from the base.

There is also a need for a more durable hinge construction. However, the prior art, when considered as a whole at the time the present invention was made, neither taught nor suggested to those of ordinary skill in this field how an improved hinge construction could be provided.

SUMMARY OF THE INVENTION

The novel hinge construction of this invention includes a base, a connecting member that is easily attached to and detached from said base, and a hinge body that includes a body member which is connected to the base through a unique connecting means.

The base has a stopper for engaging the connecting means. The connecting means includes a clip and a connector. The clip has a transverse hooking bar at its first end; the hooking bar detachably engages the stopper formed in the base. The connector is movably connected to the clip and is displaceable relative thereto along the longitudinal axis of the hinge construction. The connector is engaged to the body member of the hinge body.

A bias means is placed between the clip and the connector to bias the clip so that the transverse hooking bar at its first end engages the stopper formed in the base when the hinge is assembled. Thus, the hooking bar can be disengaged from the stopper by overcoming the bias means.

The stopper has a tapered upper surface so that the transverse hooking bar slides along said surface when the clip is being attached to the base. The bias means urges the clip rearwardly with respect to the connector at all times, so the clip is displaced from its position of repose when said hooking bar is sliding forwardly along said stopper. When the hooking bar slides over the forward end of the stopper, said hooking bar is pulled into a recess under the stopper when the clip returns to its position of repose under the power of the bias means.

Accordingly, to disengage the hinge body from the base, the clip is slid forwardly against the bias provided by the bias means, so that hooking bar 42 reverses its above-described path of travel and thereby disengages from the stopper. Thus, the hinge body and base are connected together in one simple procedure and are disconnected in a second simple procedure. It should be noted that the connection procedure requires only that the hinge body be fitted over the base, because the movement of the locking bar into engagement with the recess under the stopper is automatic, i.e., the locking bar rides over the stopper as described in the absence of any manipulation of the connecting means. The connecting means itself is manipulated to accomplish disconnection, i.e., as mentioned earlier, the clip and hence the locking bar at its leading end are manually displaced forwardly to remove the locking bar from its recess. However, after that has been accomplished, the bias means returns the clip and its locking bar to their position of repose.

In a second embodiment of the invention, a second stopper is provided in alignment with the first stopper, rearwardly thereof. A second transverse hooking bar, carried by the clip rearwardly of the first-mentioned hooking bar, engages the second stopper in substantially the same way said parts are engaged in the first embodiment.

The provision of the second transverse hooking bar and the second stopper reduce the force required to connect the hinge body to the base. Moreover, the moment generated upon opening or closing of the hinge body is applied to the respective points of engagements of said first and second stoppers. Since these engagement points are longitudinally spaced from one another, the distance between the center of the moment and each of said hooking points operates to reduce the force applied upon each hooking position. The reduction of the force applied upon each transverse hooking bar increases the durability of the hinge.

To prevent inadvertent detachment of the hinge body from the base member, a cover member is provided that protects the clip from inadvertent displacement. This insures that the article of furniture and the door hingedly mounted thereto will not be inadvertently detached by inadvertent depression of said clip.

It will thus be seen that the primary object of this invention is to provide a hinge construction having a hinge body that is quickly and easily detached from its base by means of a biased connecting means disposed between the hinge body and the base.

Another important object of the invention is to provide a durable hinge construction.

These and other important objects, advantages, and features of the invention will become apparent as this description proceeds.

The invention accordingly comprises the features of construction, combination of elements and arrangement of parts that will be exemplified in the construction set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
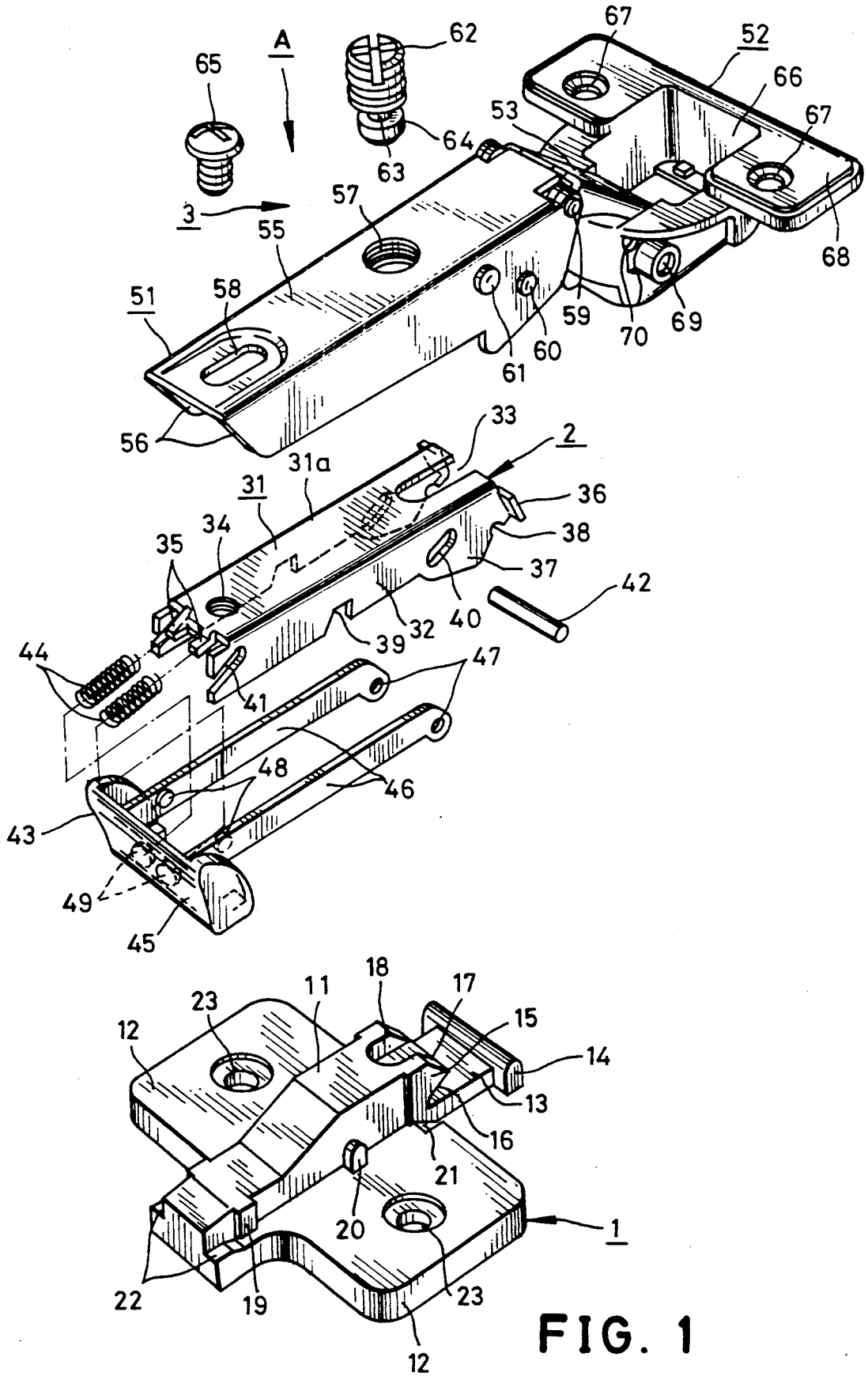
FIG. 1 is an exploded perspective view of a first embodiment of the hinge construction, showing the hinge body, the base, and the connecting means for releasably interconnecting the hinge body and the base.
Figure 2:
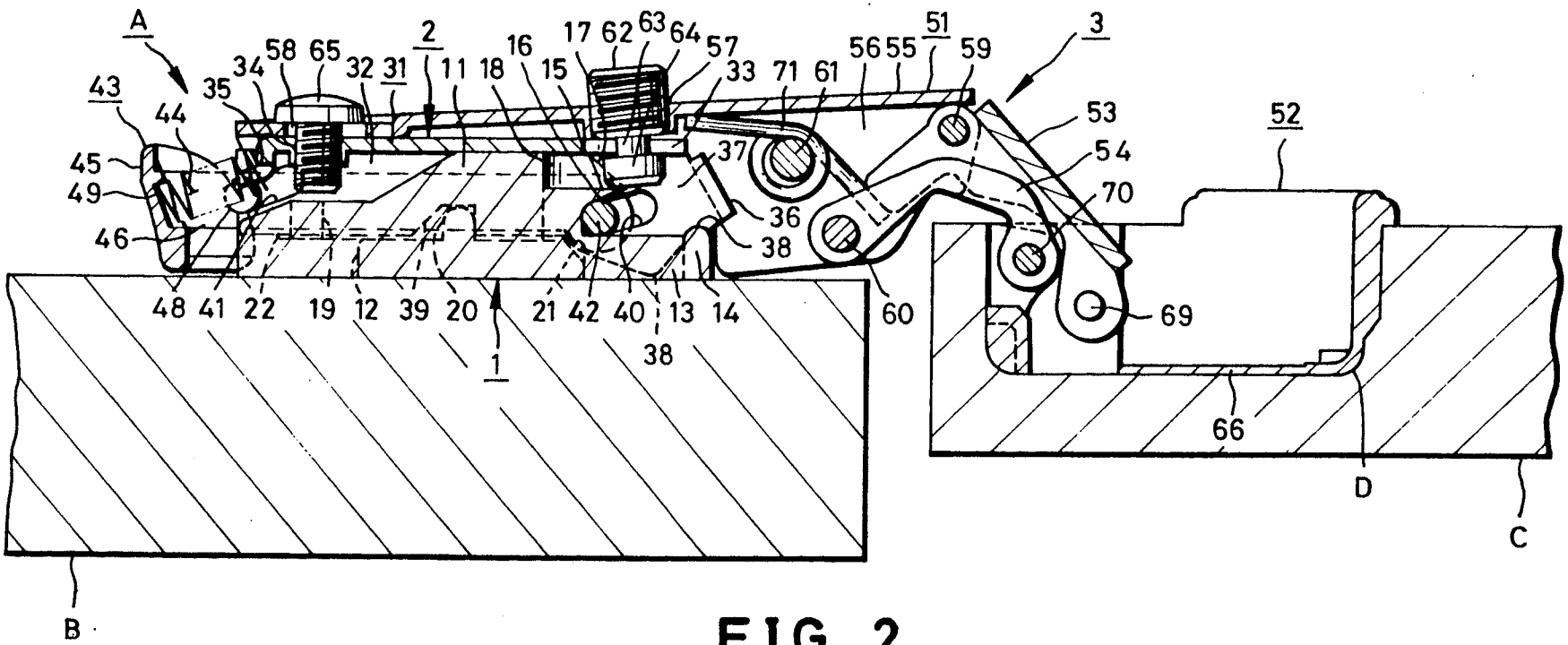
FIG. 2 is longitudinal sectional view of an assembled hinge.
Figure 3:
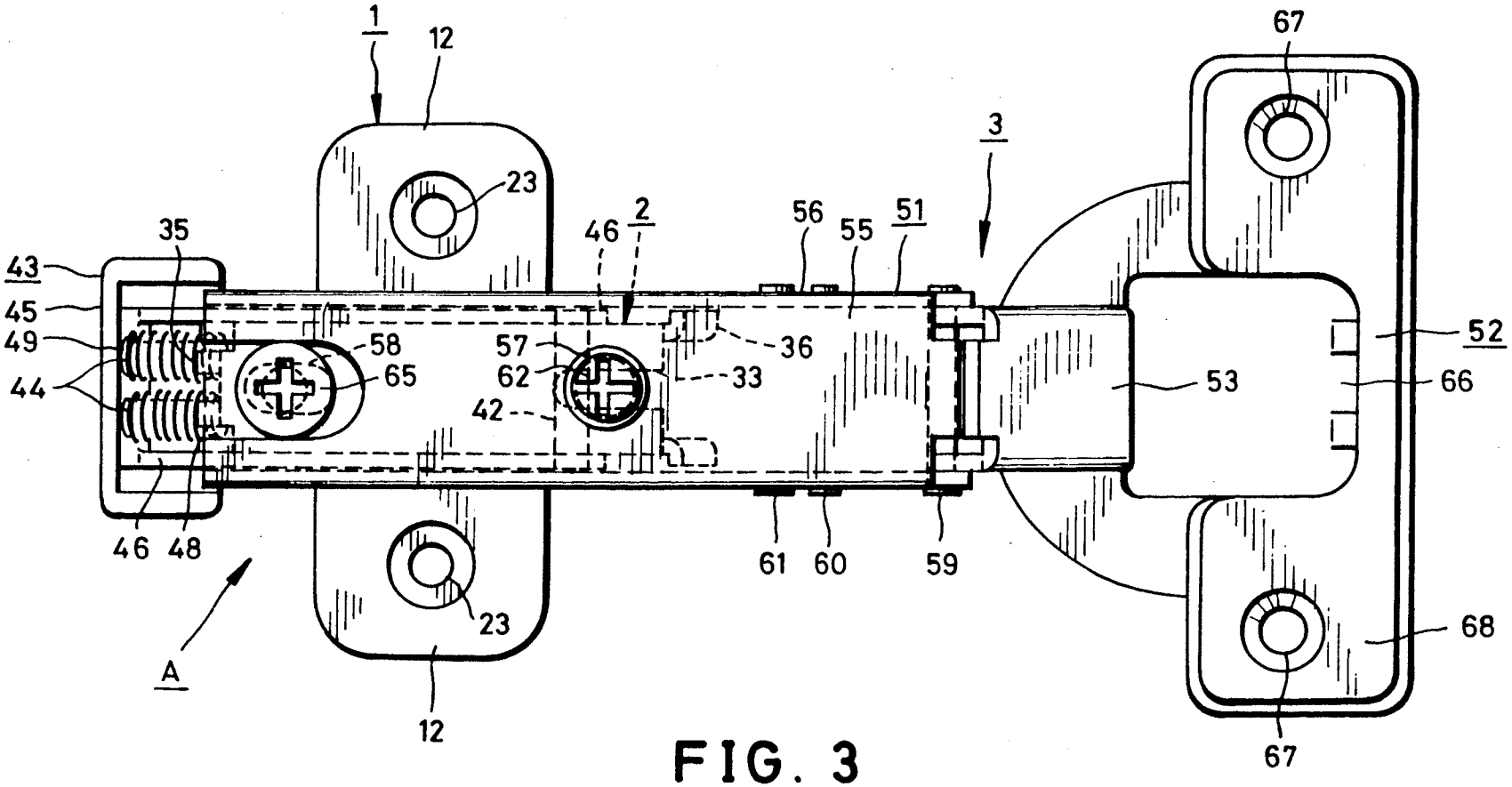
FIG. 3 is a plan view of the assembled hinge.

Referring to FIGS. 1–3, it will there be seen that a first embodiment of the present invention is indicated by the letter A as a whole. Hinge A includes base 1, connecting member 2 that removably engages base 1 in the manner to be hereinafter described, and hinge body 3 that engages connecting member 2.

Base 1 includes base body 11 having a predetermined longitudinal extent, and flat plates 12 that extend laterally therefrom. Protruding member 13 protrudes forwardly in a horizontal plane from base body 11, and includes transversely disposed positioning ridge 14 at the forwardmost end thereof. Note that positioning ridge 14 extends above the plane of protruding member 13 and has a transverse extent greater than the transverse extent of protruding member 13.

Stopper member 15 has the same width as protruding member 13 and has a pointed configuration; note upwardly inclined lower stopping surface 16 and downwardly inclined upper guide surface 17. Recess or undercut 18 having a "U" shape is formed in stopper member 15.

The transverse extent of base body 11 is tapered slightly downwardly from its forwardmost or leading end to its rearwardmost or trailing end. Thus, ridges 19 near the trailing end of base body 11 extend laterally therefrom, but have the same lateral extent as stopper 15. A pair of laterally extending positioning protrusions 20 are also formed in base body 11, about mid-length thereof as shown.

Guide surface 21 is formed in each fitting plate 12 at the leading end thereof where it joins base body 11.

Base block 22 is formed in the trailing end of each fitting plate 12 on opposite sides of base body 11.

A fitting hole 23 is bored in each fitting plate 12 on opposite sides of base body 11; the bores are countersunk as shown.

Connecting member 2, shown in the middle of FIG. 1, includes four primary parts: elongate connector 31, clip 43, transverse hooking bar 42, and a pair of coil springs 44.

Connector 31 includes enlongate, flat top wall **31*a*, and side walls 32 formed by bending the sides of top wall 31*a* downwardly. An elongate, "U" shaped slot 33 is formed in the leading end of top wall 31*a* as shown, and a tapped hole 34 is bored through the trailing end thereof. A pair of parallel fitting pieces 35 extend rearwardly from the trailing end of top wall 31*a*. Laterally extending ears 36 are formed in the leading end of each side wall 32 by bending the forward end thereof laterally outwardly. A generally triangular positioning piece 37 is integrally formed at the forward, lowermost end of each side wall 32. When hinge A is assembled, these triangular positioning pieces 37 slidably receive protruding part 13 of base therebetween. Similarly, positioning recess 38 formed in the leading end of each side wall 32 abuttingly engages the complementally formed top wall of positioning ridge 14 of base when the hinge is assembled. Another positioning recess 39 is formed about mid-length of each side wall 32, and slidably receives positioning protrusions 20 of base 1**.

Upwardly inclined guide grooves 40 are formed in each side wall 32 near its leading end, and open-ended guiding slots 41 are formed in the trailing end thereof.

Clip 43 includes transversely disposed operating part 45, and a pair of parallel, transversely spaced apart connecting pieces 46 that extend forwardly therefrom. Connecting pieces 46 slidably receive therebetween side walls 32 of connector 31 when the hinge is assembled. Aperture 47 is formed in the leading end of each connecting piece 46 for slidably receiving the opposite ends of transverse hooking bar 42. Inwardly projecting guide studs 48 are formed on each connecting piece near the trailing end thereof; these guide studs are slidably received within their associated guide slots 41 of connector 31 when the hinge is assembled. Recesses 49 are formed in the leading side of operating member 45 and said recesses receive the trailing ends of their associated springs 44 as indicated by the assembly lines in FIG. 1. Note that fitting pieces 35 are slidably received within the leading end of each spring 44. To assemble connector 2, side walls 32 are first slidably positioned in sandwiched relation between connecting pieces 46 so that each connecting piece 46 is disposed in abutting, laterally outward relation to its associated side wall 32. Apertures 47 will now be in alignment with guide grooves 40; hooking bar 42 is inserted through said apertures and guide grooves to thereby interlock connector 31, and clip 43. As mentioned earlier, guide studs 48 are slidably disposed in their associated guide slots 41 and the springs 44 are positioned as mentioned earlier between recesses 49 and fitting pieces 35. Springs 44 displace clip 43 rearwardly relative to connector 31, so that hooking bar 42 is positioned at the trailing end of guide grooves 40 when the connector 2 is in repose, as indicated in FIG. 2. Similarly, guide studs 48 will be positioned at the trailing end of their associated guide slots 41, as also depicted in FIG. 2, when said connector 2 is in repose.

Referring now to the top of FIG. 1, it will there be seen that hinge body 3 includes a main body member 51 that is hingedly connected at its leading end to cup 52; cup 52 is attached to a furniture door when hinge A is in use. First and second link arms 53 and 54 (FIG. 2) are the primary interconnecting means for hingedly interconnecting said main body 51 and cup 52.

Body member 51, like connector 31, is "U" shaped in transverse section and includes flat, elongate top wall 55 and side walls 56 formed by bending the sides of top wall 55 downwardly. When hinge A is assembled, connector 31 is slidably received within body member 51 so that top wall 55 of body member 51 overlies top wall 31*a* of connector 2, and side walls 56 of body member 51 overlie side walls 32 of connector 31. Tapped hole 57 is formed in top wall 55, about mid-length thereof, and an elongated slot 58 is formed in the trailing end thereof. Transversely disposed rods 59, 60, and 61 are positioned in main body member 51 as shown, i.e., rod 59 is positioned in the forward, uppermost corners of side walls 56, rod 60 is positioned in trailing relation thereto, downwardly thereof, and rod 61 is positioned in trailing relation to rod 60, upwardly thereof as depicted.

Adjusting screw 62 connects together main body part 51 and connector 31. When the external threads of adjusting screw 62 engage the internal threads of aperture 57, disk 64 engages the underside of top wall 31*a* of connector 31 and the reduced diameter part 63 of adjusting screw 62 extends through slot 33 formed in the leading end of connector 31. Further interconnection of main body 51 and connector 31 is accomplished by extending set screw 65 through elongated slot 58 so that the external threads of set screw 65 screw threadedly engage the internal threads of tapped aperture 34 formed in top wall 31*a* of connector 31. Thus, the vertical spacing between top wall 55 of main body member 51 and top wall 31*a* of connector 31 is adjustable by rotation of adjusting screw 62 and the longitudinal positioning of said main body member 51 with respect to connector 31 is adjustable when set screw 65 is loosened to allow relative sliding displacement of said parts in a longitudinal direction. Note that clip 43 of connecting member 2 is longitudinally displaceable even though body member 51 is attached to connector 31.

Cup 52 includes a cup-shaped inset part 66 formed in laterally extending fitting plates 68, each of which has a fitting hole 67 formed therein. Note transversely disposed rods 69 and 70 that extend across inset 66, as perhaps best shown in FIG. 2.

First link arm 53 is "U" shaped in transverse section; its leading end is rotatably connected to rod 69 of cup 52 and its trailing end is rotatably connected to rod 59 at the leading end of main body member 51. Similarly, the leading end of link arm 54 is rotatably connected to rod 70 of cup 52 and its trailing end is rotatably connected to rod 60 of body member 51. In this manner, cup 52 is rotatably connected to body member 51 by the first and second link arms 53 and 54. A torsion spring 71 surrounds rod 61 as shown in the middle of FIG. 2, and said torsion spring holds cup 52 in the open position, relative to main body 51, as depicted in FIGS. 1-3.

In FIG. 2, the reference numeral B indicates a side panel of an article of furniture, and the reference numeral C indicates a door of said article of furniture.

To use hinge A, base 1 is secured to side panel B of the furniture by tightening screws through fitting holes 23 formed in base 1.

Cup 52 of hinge body 3 is inserted into recess D formed in door C of the furniture and is secured therein by fastening Wood screws inserted through fitting holes 67 of cup 52.

Connecting member 2 is then attached to body member 51, and body member 51 is secured to base 1 through said connecting member 2.

More particularly, connector 31 and clip 43 are connected together in the manner described above, and connector 31 is fitted onto base body 11 of base 1, thereby causing hooking bar 42 to abut and slide against guide surface 17 of stopper 15. Due to the inclination of guide surface 17, connector 31 is driven forwardly, and recesses 38 formed in triangular positioning pieces 37 come into abutting contact with transverse positioning ridge 14 of base 1, thereby constraining connector 31 against further forward movement.

Connector 31 is then pushed toward base 1 to cause the respective front edges of positioning pieces 37 to slide onto positioning ridge 14. The leading ends of guide grooves 40 move rearwardly until such rearward movement is stopped by transverse hooking bar 42. Hooking bar 42 slides along guide surface 17 of stopper 15 until it extends beyond the leading edge thereof; bias means 44 is then unloaded and clip 43 is driven rearwardly with respect to connector 31 and hooking bar 42 enters undercut 16 as it returns to the trailing end of guide grooves 40 under the bias of springs 44. Such position is depicted in FIG. 2. Positioning recesses 38 and 39 formed in connector 31 engage positioning ridge 14 and positioning protrusions 20 respectively. The trailing ends of side walls 32 of connector 31 abut against their associated base blocks 22 formed in base 1.

In this manner, the fitting of body member 51 of hinge body 3 to base 1 is easily accomplished.

The aforesaid alignment of positioning recesses 38 and 39 of connector 31 with the positioning ridge 14 and the positioning protrusions 20 of base 1 determine and maintain the position of connector 31 with respect to the longitudinal direction. Similarly, the lateral or transverse position of connector 31 is determined and maintained by the sliding engagement of side walls 32 of connector 31 with the upstanding side walls of base body 11 of base 1. Moreover, the engagement of hooking bar 42 and stopper 15 maintains the downward hold of body member 51 to base 1. Thus, body member 51 is firmly secured to base 1 and said parts are firmly secured to one another.

To disengage body member 51 from base 1, operating part 45 of clip 43 is pushed forwardly, thereby compressing coil springs 44, and hooking bar 42 is displaced forwardly so that it exits undercut 16 and is therefore no longer engaged by stopper 15. Body member 51 is then simply lifted from base 1.

Figure 4:
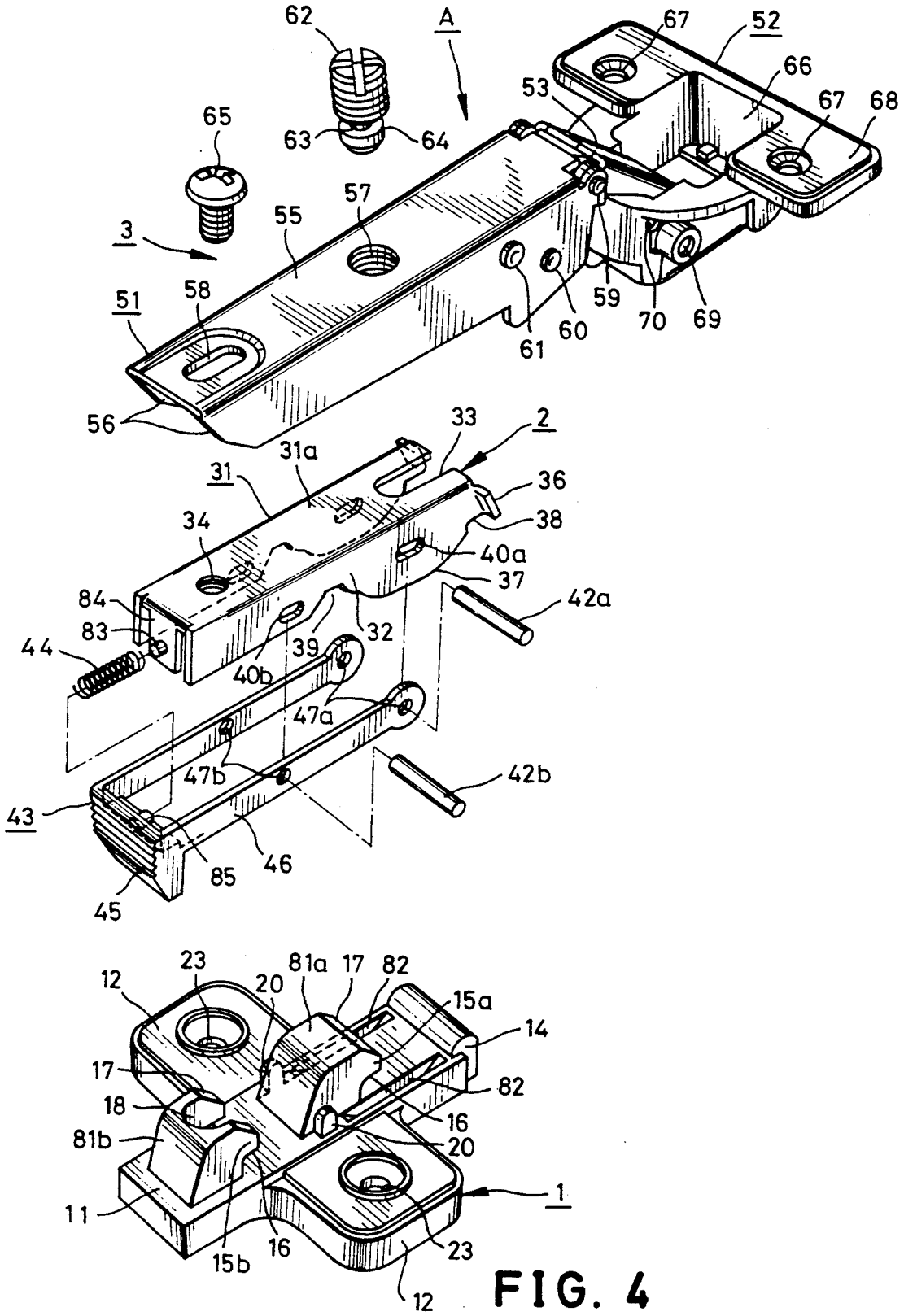
FIG. 4 is an exploded perspective view of a second embodiment of the invention.
Figure 5:
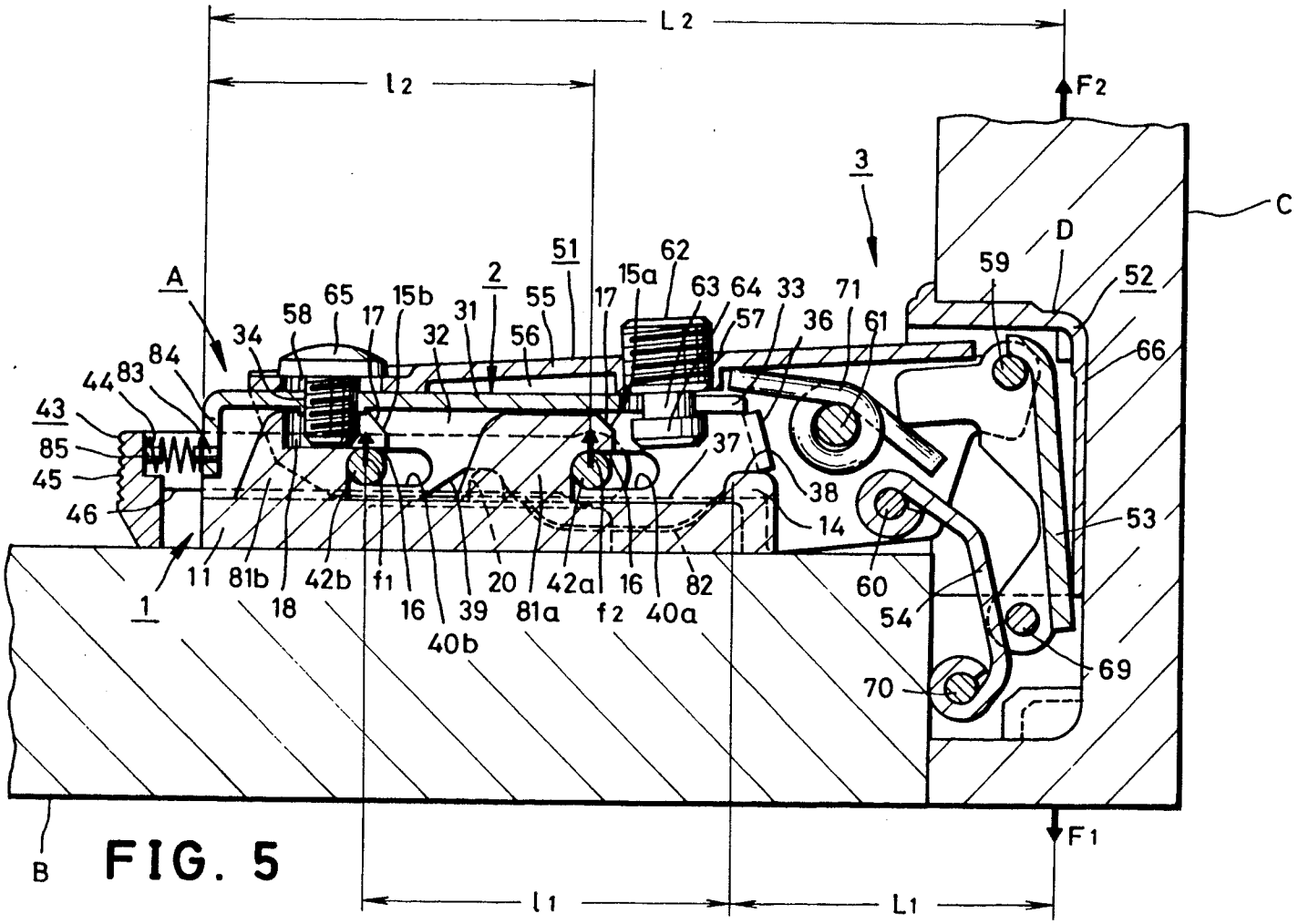
FIG. 5 is a longitudinal sectional view of said second embodiment.

The second embodiment of the invention is shown in FIGS. 4 and 5.

As shown at the bottom of FIG. 4, base 1 includes a forward upwardly projecting part 81*a* and a rearward upwardly projecting part 81*b*; both of said upwardly projecting parts project upwardly with respect to base body 11. Forward stopper 15*a* is integrally formed on the leading edge of part 81*a*, and stopper 15*b* is similarly formed on the leading edge of part 81*b*. Positioning protuberances 20 are formed at the base of forward upwardly projecting part 81*a*, on opposite sides thereof, and a "U" shaped recess 18 is formed in rearward upwardly projecting part 81*b*. Each upwardly projecting part 81*a* and 81*b* has a downwardly sloping guide surface 17 formed in its leading edge. However, note that guide surface 17 on the forward upwardly projecting part 81*a* is continuous, whereas guide surface 17 of rearward upwardly projecting part 81*b* is bifurcated by "U" shaped recess 18.

A pair of parallel, longitudinally aligned positioning grooves 82 are formed in the leading part of base 11. Transverse positioning ridge 14 protrudes upwardly from the plane of base 11.

Connector 31 of connecting member 2 of this second embodiment is shown in the middle of FIG. 4. The trailing end of top wall 31*a* is bent downwardly ninety degrees to form trailing wall or fitting piece 84. A spring-positioning cylindrical protuberance 83 is formed integrally with fitting piece 84 and extends in a trailing direction therefrom. Elongate guide grooves 40*a* and 40*b* are formed in side walls 32 of connector 31 as shown. The leading end of each side wall 32 also includes an integrally formed, downwardly extending positioning piece 37; when the hinge is assembled, said positioning pieces 37 extend into grooves 82 formed in base 1.

Clip 43 includes connecting pieces 46 and apertures 47*a* and 47*b* are formed in the leading end and mid-length of said connecting pieces respectively. As indicated by the assembly lines in FIG. 4, when connecting pieces 46 are placed into overlying relation with their respective side walls 32, apertures 47*a* in said connecting pieces align with slots 40*a* in side walls 32, and apertures 47*b* in said connecting pieces align with slots 40*b* in side walls 32. Transverse hooking bars 42*a*, and 42*b* are then slidably inserted through their associated apertures and slots as indicated by said assembly lines to thereby interconnect connector 31 and clip 43. Thus, hooking bar 42 serves as the front hooking means and hooking bar 42 serves as the rear hooking means. The trailing end of bias means 44 receives cylindrical protuberance 85 that extends forwardly relative to operating part 45 of clip 43. Accordingly, as in the first embodiment, bias means 44 urges clip 43 rearwardly with respect to connector 31 so that hooking bars 42*a*, 42*b* are positioned at the trailing ends of slots 40*a*, 40*b*, respectively, when the assembly is in repose, as depicted in FIG. 5.

Hinge body 3 of this second embodiment has the same structure as hinge body 3 of the first embodiment, as will be apparent from a comparison of the top of FIGS. 1 and 4.

To attach body member 51 of hinge body 3 to base 1, clip 43 is engaged to connector 31 in the manner described above, and connector 31 is fitted onto base body 11 of base 1, thereby causing hooking bars 42*a* and 42*b* to slidably engage the respective guide surfaces 17 of stoppers 15*a* and 15*b*. Due to the downward inclination of said guide surfaces 17, connector 31 slides forwardly relative to clip 43 as hooking bars 42*a*, 42*b* slide downwardly and forwardly on said guide surfaces 17. The leading part of positioning pieces 37 of connector 31 come into contact with positioning ridge 14 of base 1; this constrains connector 31 from further forward movement.

Connector 31 is then pushed toward base 1 to cause the forward ends of positioning pieces 37 to slide relative to positioning ridge 14. This causes connector 31 to move rearwardly, and guide grooves 40*a*, 40*b* are therefor displaced rearwardly as well until hooking bars 42*a*, 42*b* abuttingly engage the leading ends of their respective guide slots 40*a*, 40*b*. Thus, hooking bars 42*a*, 42*b* slide along the respective guide surfaces 17 of stoppers 15*a*, 15*b*. Simultaneously, connector 31 moves rearwardly, and clip 43 moves forwardly together with said hooking bars 42*a* and 42*b*, thereby compressing coil spring 44.

Then, as connector 31 is pressed further towards base 1, positioning pieces 37 of connector 31 are received within positioning grooves 82 formed in base 1, and positioning recesses 38 and 39 formed in side walls 32 of connector 31 enter into engaging relation with positioning ridge 14 and positioning protrusions 20 of base 1, respectively. Moreover, the trailing ends of side walls 32 enter into abutting relation with the top wall of base 1. After hooking bars 42*a*, 42*b* move forwardly and clear the leading ends of stoppers 15*a*, 15*b*, respectively, said hooking bars 42*a*, 42*b* begin rearward motion under the bias of coil spring 44 until they slidably engage stopping surfaces of undercuts 16 of said stoppers 15*a*, 15*b*, as perhaps best depicted in FIG. 5. Thus, the fitting of body member 51 to base 1 is easily accomplished.

Thus, when body member 51 is secured to base 1, positioning recesses 38 and 39 of connector 31 abut positioning ridge 14 and positioning protuberances 20 of base 1, respectively. This determines and maintains the longitudinal position of connector 31. The transverse position of connector 31 is determined and maintained by the overlying relation of side walls 32 of connector 31 with the side walls of base body 11 and by engagement of positioning pieces 37 of connector 31 in positioning grooves 82 of base 1. Transverse hooking bars 42*a* and 42*b* are biased rearwardly by coil spring 44 and are forced to travel forwardly against said bias upon engaging stoppers 15*a* and 15*b*, respectively. Said transverse hooking bars are returned to their position of repose in the rearward ends of grooves 40a, 40b, respectively, when said hooking bars have entered into the undercuts 16 formed in stoppers 15a, 15b. This maintains the downward hold of connector 31 to base 1, and prevents body member 51 from coming loose.

To remove body member 51 from base , operating part 45 of clip 43 is pushed forwardly, overcoming the bias of coil spring 44. Hooking bars 42a and 42b are therefor displaced towards the leading ends of their respective stoppers 15a, 15b, and exit their respective undercuts. Body member 51 is then removed from base 1 by removing connector 31 from base 1.

Reference should now be made to FIG. 5, where downwardly directed force $F_1$ is applied to door C; force $F_1$ appears upon opening or closing door C. The moment working upon hinge A is then equal to $F_1 \times L_1$. As indicated in FIG. 5, the moment concentrates at positioning ridge 14 and positioning recesses 38. The moment is also received by rear stopper 15b and hooking bar 42b. The force applied to stopper 15b and hooking bar 42b is defined as $f_1$ and is equal to $(F_1 \times L_1)/l_1$. Therefore, value $f_1$, i.e., the force applied to hinge A, is reduced by increasing value $l_1$. Value $l_1$ in the first embodiment (FIGS. 1-3) is small; accordingly, value $f_1$ is great because hooking bar 42 is positioned at the leading end of connector 31. In the second embodiment, however, value $l_1$ can be made large, because hooking bar 42b is positioned about mid-length of connecting pieces 46.

Where an upwardly directed force $F_2$ is applied to door C by opening or closing said door, as indicated in the upper right corner of FIG. 5, the moment working upon hinge A is equal to $F_2 \times l_2$, and said force concentrates on the points where the trailing end of base 1 abuts the trailing ends of side walls 32 of connector 31, said moment being received by front stopper 15a and hooking bar 42a of connector 31. The force applied to stopper 15a and hooking 42a is formulated as $f_2$ equals $(F_2 \times L_2)/l_2$. Therefore, value $f_2$, i.e., the force applied to hinge A, is reduced by increasing value $l_2$. If force is applied to rear stopper 15b and hooking bar 42b, the value $l_2$ is small and $f_2$ is large. In the second embodiment, however, value $l_2$ can be made large, because hooking bar 42a and stopper 15a are positioned at the leading end and toward the trailing end as well. Thus, it is possible to reduce the force applied to hinge A that results from opening or closing of door C. This improves the durability of hinge A. This increase in durability is a function of the provision of the two stoppers 15a, 15b, and the two hooking bars, 42a and 42b.

Figure 6:
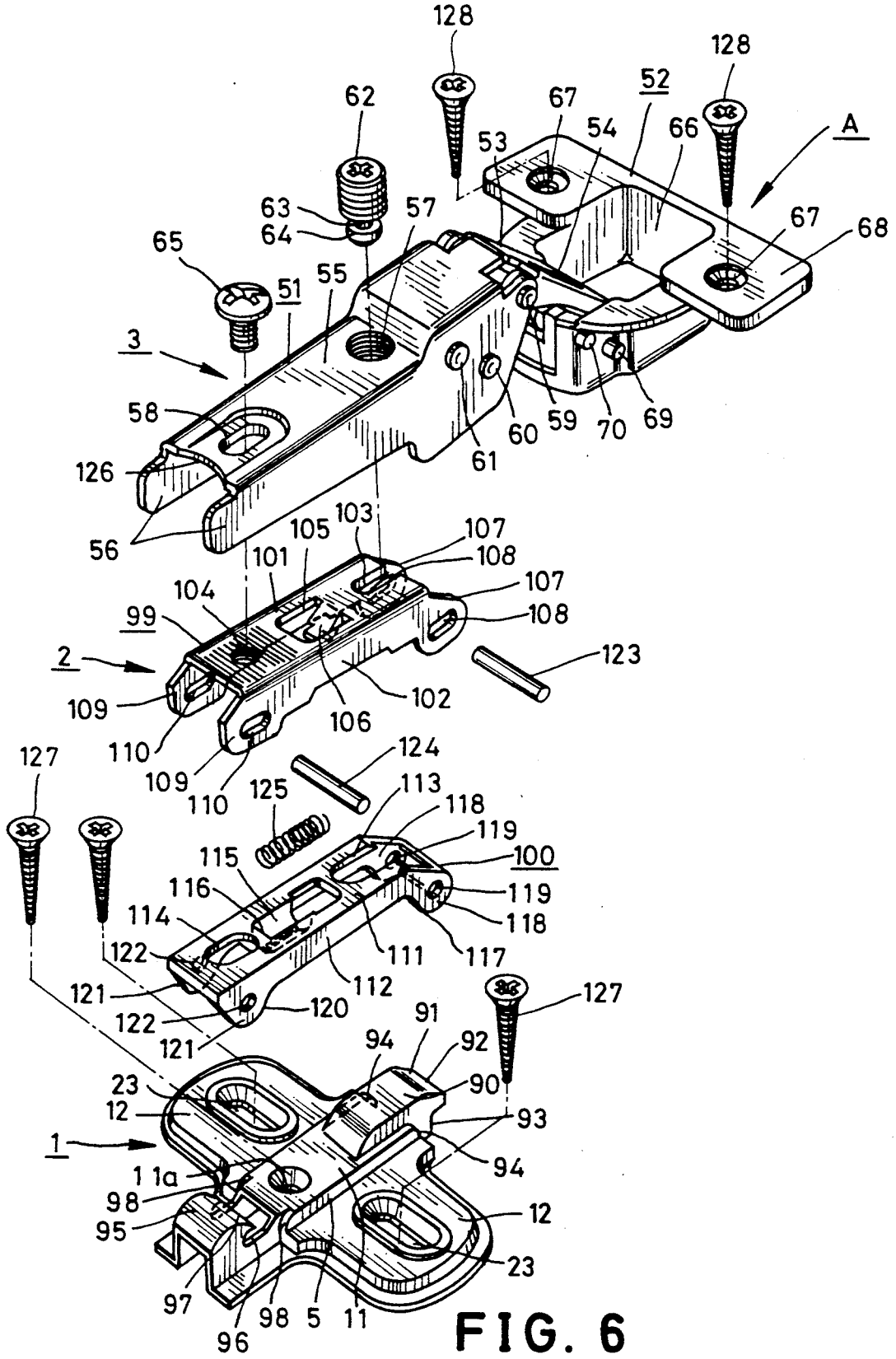
FIG. 6 is an exploded perspective view of a third embodiment.
Figure 7:
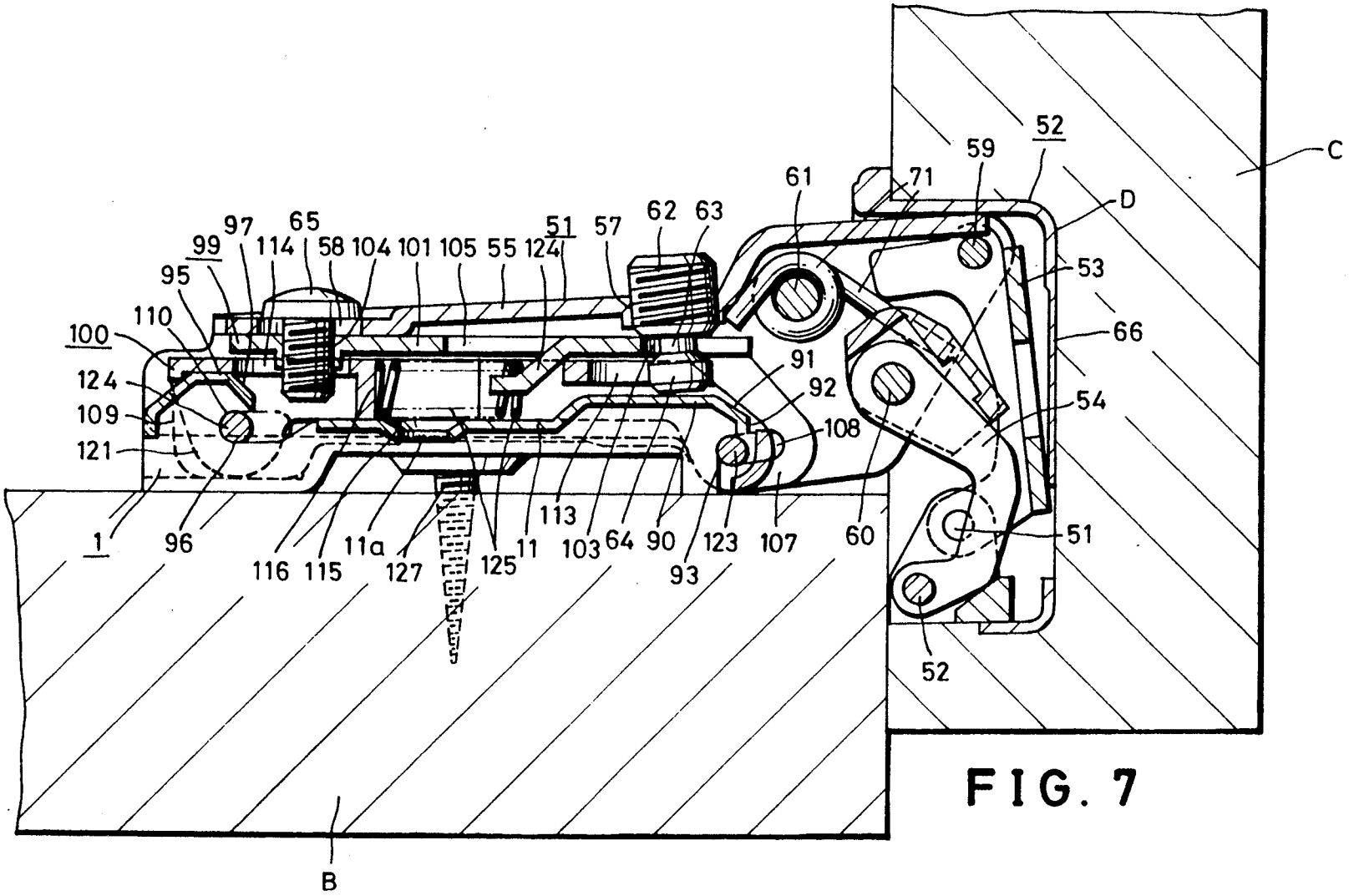
FIG. 7 is a longitudinal sectional view of an assembled hinge of the third embodiment.
Figure 8:
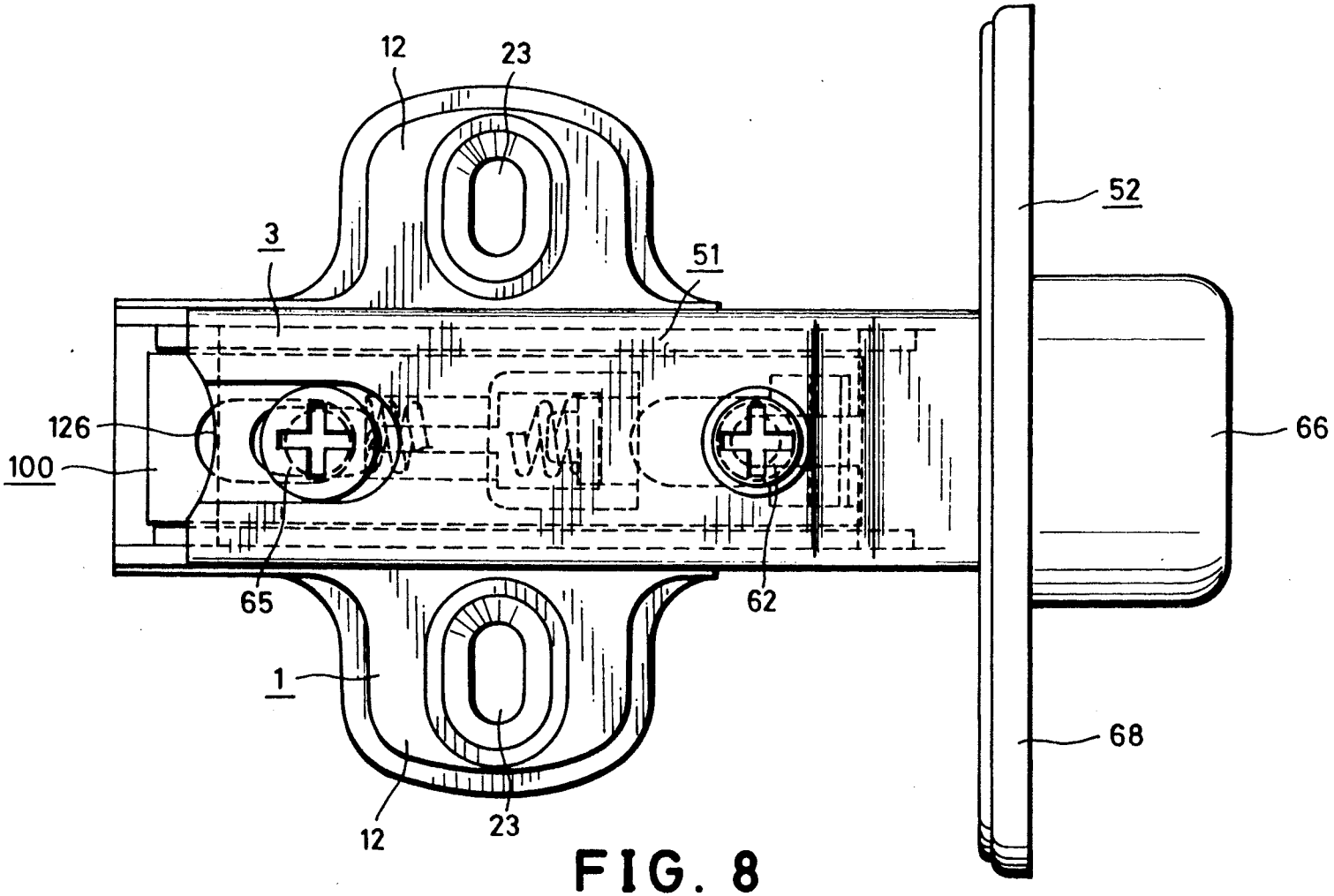
FIG. 8 is a top plan view of the assembled hinge of the third embodiment.

The third embodiment of the invention is shown in FIGS. 6-8.

As in the first and second embodiments, hinge A includes base 1 Which is attached to a side panel B of furniture, connecting means 2 for releasable engagement with base 1, and hinge body 3 adapted for engagement with connecting member 2 and adapted for attachment to door C of said furniture.

Base 1 includes elongate base body 11 and a pair of laterally extending flat fitting plates 12. Step 5 is formed between base body 11 and each fitting plate 12. A laterally elongated fitting hole 23 is bored through each fitting plate 12. An upwardly projecting protuberance 90 is formed at the leading end of base body 11, and integrally formed front stopper 92 extends forwardly therefrom. Note downwardly sloping guide surface 91 formed in said front stopper 92. Vertical stopper wall 93 is overhung by stopper 92 as shown. Curved guide surface 94 is formed at the leading end of each step 5 as shown, and curved guide surface 98 is formed in the trailing end of each step.

Rear stopper 95 is positioned at the trailing end of base body 11, and it has approximately the same height and width as protuberance 90. Stopping recess or undercut 96 is formed in the leading end of rear stopper 95, and downwardly sloping guide surface 97 is formed in the uppermost, leading end of rear stopper 95 as shown. Aperture 11a is formed in base body 11, approximately mid-length thereof.

Referring now to the middle part of FIG. 6, it will there be seen that connecting means 2 includes connector 99 and plastic or metallic clip 100.

Connector 99 includes an elongate top wall 101 and side walls 102 formed by bending downwardly both sides of top wall 101. A longitudinally extending, open-ended slot 103 is formed in the leading end of top wall 101. An internally threaded aperture 104 is formed in top wall 101 near its trailing end, and a rectangular opening or window 105 is formed about mid-length of top wall 101 as shown. Said window 105 includes a rearwardly projecting, downwardly sloping stop wall 106 which is integrally formed with top wall 101. Forwardly projecting pieces 107 are integrally formed with each side wall 102 and each of said projecting pieces 107 has a longitudinally extending guide hole 108 formed therein in transversely opposed and aligned relation to one another. Similarly, at the trailing end of connector 99, rear projecting pieces 109 are integrally formed with side walls 102 and each of said rear projecting pieces has formed therein an elongated guide hole 110, said guide holes being disposed in transverse relation to one another.

Clip 100 includes elongate top wall 111 which is adapted to underlie top Wall 101 of connector 99. Clip 100 further includes side walls 112 formed by bending downwardly both sides of top wall 111; said side walls 112 slidably engage the inner surfaces of side walls 102 of connector 99 when connector means 2 is assembled.

Guide recess 113 is formed in the leading end of top wall 111, in open communication with the leading edge thereof as shown. Guide recess 113 corresponds to the stopping recess 103 formed in the leading end of connector 99. Elongate guide hole 114 is formed in top wall 111 near the trailing end thereof; it corresponds to tapped hole 104 formed in top wall 101 of connector 99. An elongate recess 115 is formed mid-length of top wall 111; a vertical stop wall 116 is positioned at the trailing end of said recess 115.

Forwardly projecting pieces 118 are formed at the respective leading ends of each side wall 112 and the trailing end of each projecting piece 118 is curved as at 117. Curved hooking end 117 is fitted against a corresponding curved surface formed in the trailing end of each front projecting piece 107 of connector 99. These curved parts abuttingly engage and are guided by the curved guide surfaces 94 formed in the leading end of step 5 of base 1. A through hole 119 is formed in each connecting piece 117, and said through holes 119 are in alignment with their associated elongated guide holes 108 formed in projecting pieces 107 of connector 99 when the hinge is assembled. Similarly, rear projecting pieces 121 are integrally formed with side walls 112 at the trailing end thereof, and a curved hooking surface 120 is formed in the leading edge of each rear projecting piece 121. These curved hooking surfaces 120 align with the respective inner surfaces of rear projecting pieces 109 of connector 99 when the hinge is assembled and said curved guide surfaces slidingly engage guide surfaces 98 formed in the trailing end of step 5 of base 1. Through holes 122 are formed in each rear projecting piece 121 of clip 100 and said through holes 122 are in alignment with elongate guide holes 110 of connector 99 when the hinge is assembled. To assemble connector 99 to clip 100, connector 99 is placed into overlying relation to clip 100 so that top wall 101 overlies top wall 111 and side walls 102 overlie side walls 112. Transverse hooking bar 123 is then inserted through elongate guide holes 108 and through holes 119 and trailing hooking bar 124 is inserted through elongate guide holes 110 and through holes 122. Thus, the opposite ends of leading hooking bar 123 are retained by guide holes 108 and through holes 119. Similarly, the opposite ends of trailing hooking bar 124 are retained by guide holes 110 and through holes 122. Leading hooking bar 123 releasably engages the undercut area of leading stopper 92 when the hinge is assembled, and trailing hooking bar 124 releasably engages the undercut area of trailing stopper 95 when said hinge is assembled.

Coil spring 125 is positioned in recess 115 formed in top wall 111 of clip 100; the trailing end of spring 125 is positioned in abutting relation to vertical end wall 116. The leading end of spring 125 receives the trailing end of stopper 106 formed in top wall 101 of connector 99. Thus, spring 125 biases clip 100 rearwardly relative to connector 99 so that hooking bars 123 and 124 are positioned in the trailing ends of their respective guide slots 108 and 110 when the hinge is in repose, as indicated in FIG. 7. Note that this unique positioning of spring 125 shortens the overall length of the connector 99/clip 100 assembly, vis a vis the connector/assemblies of the first and second embodiments.

Hinge body 3 of this embodiment has substantially the same configuration as the hinge bodies of the first and second embodiments. Accordingly, the same reference numerals are applied to the corresponding parts of hinge body 3, and description thereof is omitted.

Operational recess 126 is formed in the trailing end of top wall 55 of hinge 3; it enables the user of the hinge to push forwardly the trailing end of clip 100 when the hinge is assembled.

To connect connector 99 of connecting means 2 to body member 51 of hinge body 3, adjusting screw 62 is screw threadedly engaged with tapped aperture 57, and annular groove 63 formed in screw 62 is slidably engaged with stopping recess 103 formed in the leading end of connector 99. When groove 63 and stopping recess 103 are so engaged, disc 64 will underlie top plate 101 of connector 99. Set screw 65 is then inserted through elongated aperture 58 formed in top wall 55, and the external threads of said set screw 65 are screw threadedly engaged with the internal threads formed in aperture 104 of connector 99. Thus, the vertical relation of body member 51 in relation to connecting means 2 is adjusted by controlling the degree of tightening of adjusting screw 62 and the relative longitudinal adjustment between said parts is adjustable upon loosening of set screw 65.

Cup 52 of hinge body 3 is rotatably connected to body member 51 by means of first and second link arms 53 and 54. Torsion spring 71, attached to shaft 61 of body member 51 (FIG. 7), is operative to hold cup 52 in its open or closed position.

To connect side panel B to door C of a piece of furniture using hinge A of this third embodiment, base 1 is secured to side panel B of the furniture by tightening screws 127 through fitting holes 11*a* and 23 of base 1 into side panel B. Cup 52 of hinge body 3 is then inserted into recess D formed in door C of the furniture and is held therein by fastening screws 128 which are inserted through fitting holes 67 of cup 52.

Next, body member 51 of hinge body 3 is secured to base 1; base 1 is already secured to side panel B. This is accomplished by fitting connecting means 2, already attached to body member 51, onto base 1. When body member 51 of hinge body 3 is fitted onto base body 11 of base 1, hooking bar 123 at the leading end of connecting means 2 slidingly abuts guide surface 91 of front stopper 92. The leading end of clip 100 then comes into contact with projecting portion 90 of base 1. Body member 51 is then moved rearwardly along base 1, and front projecting pieces 118 of clip 100 come into contact with curved guide surfaces 94 of projecting portion 90. Hooking bar 123 rides over the forward end of front stopper 92 and is pulled thereunder by the bias of spring 125 because said bias continually urges clip 100 rearwardly. This restrains body member 51 from further rearward movement.

Rear hooking bar 124 also comes into sliding engagement with guide surface 97 of rear stopper 95 of base 1.

Body member 51 is pushed further against base 1; this results in rotational movement of rear hooking bar 124 about the pivot axis defined by forward hooking bar 123. Thus, rear hooking bar 124, guided by guide surface 97, is constrained to move forwardly, i.e., towards front hooking bar 123. This loads coil spring 125. Rear hooking bar 124 and front hooking bar 123 therefore move forwardly in their associated elongated guide holes 110 and 108 formed in connector 99, thereby moving clip 100 forwardly relative to connector 99. Connector 99 does not move forwardly because it is screw threadedly engaged to body member 51 of hinge body 3.

When rear hooking bar 124 clears the leading edge of guide surface 97 and enters into the retaining recess thereunder, curved hooking ends 117 of front projecting pieces 118 are guided by curved guide surfaces 94 of base 1, thereby displacing body member 51 relative to base 1, and curved hooking ends 120 of rear projecting pieces 121 are guided by curved guide surfaces 98 of base 1, thereby fitting clip 100 to base 1. Note that clip 100 displaces rearwardly, under the influence of bias means 125, when rear hooking bar 124 enters into the recess 96 defined by rear stopper 95.

The engagement of hooking bars 123 and 124 by forward and rearward stoppers 92 and 95 holds clip 100 against longitudinal, transverse, and vertical movement relative to base 1. In this way, clip 100 cannot separate from base 1 inadvertently.

To disengage body member 51 of hinge body 3 from base 1, the trailing end of clip 100 is manually displaced forwardly; the above-mentioned operating recess 126 formed in the trailing end of top plate 55 of body member 51 enables such forward displacement of said clip as aforesaid. This action loads coil spring 125. Moreover, hooking bars 123 and 124 displace forwardly in their associated elongated guide slots 108 and 110, respectively. As hooking bars 123 and 124 travel forwardly, they escape their respective recesses beneath front and rearward stoppers 92 and 95. Moreover, as rear hooking bar 124 rides upwardly, body member 51 is pushed upwardly, i.e., away from base 1. This enables facile separation of clip 100 from base 1, thereby facilitating easy separation of body member 51 from base 1.

Figure 9:
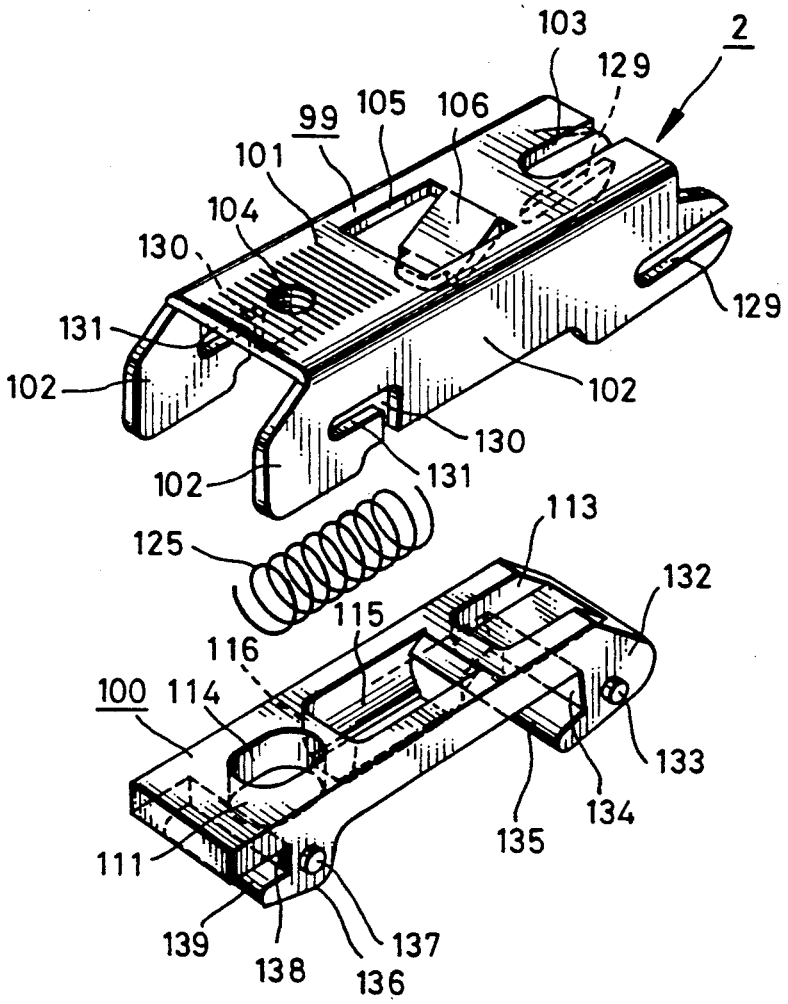
FIG. 9 is an exploded perspective view of a fourth embodiment.
Figure 10:
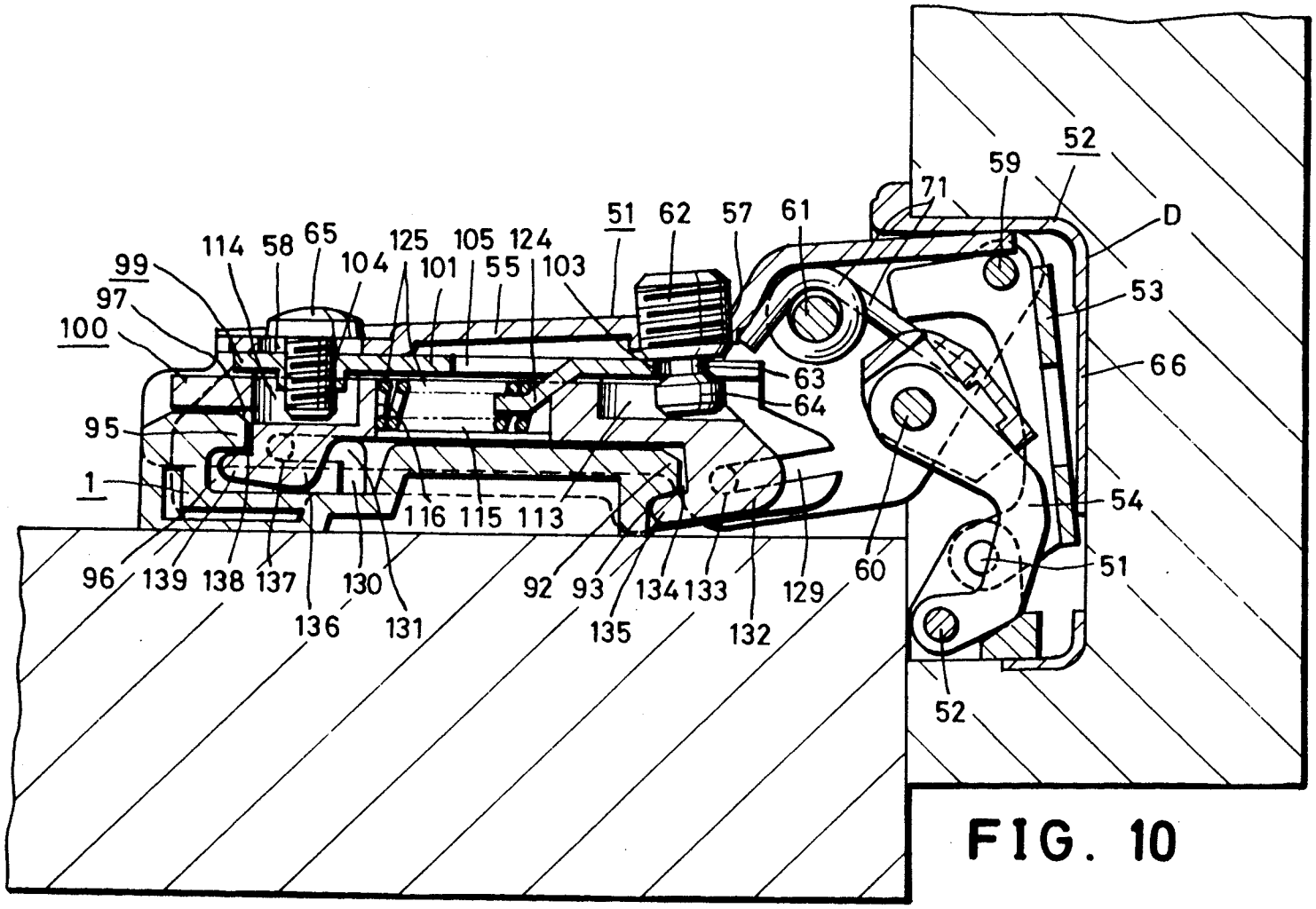
FIG. 10 is a longitudinal sectional view of the assembled hinge of the fourth embodiment.

Reference should now be made to FIGS. 9 and 10, wherein the fourth embodiment of the present invention is shown. This fourth embodiment relates to an improvement of the connector 99 and clip 100 shown in the third embodiment.

More particularly, open-ended elongate guide grooves 129 are formed in the leading end of each side wall 102 of connector 99 of this fourth embodiment. Guide grooves 129 are in cooperative, parallel alignment with one another. An open-ended vertical insertion slot 130 and a longitudinally extending guide groove 131 integral with said insertion groove 130 are formed in each side wall 102 near the respective trailing ends thereof. The insertion grooves 130 and guide grooves 131 formed in each side wall 102 are in cooperative, aligned relation with their counterparts formed in the opposing side wall.

The leading end of clip 100 includes a forwardly projecting bulge 132. A laterally outwardly extending guide stud 133 is formed integrally with each bulge 132 and said guide studs slidably engage their associated guide slots 129 formed in the leading end of connector 99; accordingly, guide studs 133 are free to displace in a longitudinal direction within said guide slots 129. Insertion recess or undercut 134 is formed in the trailing side of the leading end of clip 100 as shown. The leading end of front stopper 92 is received within insertion recess 134 when the hinge is assembled. Transversely disposed stopping ridge 135 serves as a horizontal hooking means that engages recess 93 formed by the overhang of front stopper 92.

A bulge 136 is formed at the trailing end of clip 100, and a pair of laterally outwardly extending guide studs 137 are integrally formed with each bulge 136. When connector 99 is fitted to clip 100, guide studs 137 are inserted into guide grooves 131 through their associated vertical insertion openings 130. Guide studs 137 are thus longitudinally displaceable within their associated guide grooves 131.

Transversely disposed insertion recess 138 is formed on the trailing end of bulge 136 and transversely disposed stopping ridge 139 extends in a trailing direction from said insertion recess 138. The leading edge of rear stopper 95 of base 1 is inserted into insertion recess 138 when the hinge is assembled, stopping ridge 139 serving as a horizontal hooking means to be engaged in stopping recess 96 defined by rear stopper 95.

To assemble connector 99 and clip 100, bias means 125 is compressed and inserted into container recess 115 formed in clip 100. The leading end of bias means 125 fits around and abuttingly engages the trailing edge of projecting stopper means 106 of connector 99, and the trailing end of said bias means abuttingly engages vertical stopping wall 116 at the trailing end of container recess 115. Guide studs 133 and 137 are inserted into their respective guide grooves 129 and 130 to complete said assembly. Thus, connector 99 is attached to clip 100, but is free to displace longitudinally relative thereto. Bias means 125 continually urges clip 100 rearwardly so that guide studs 133 and 137 are positioned at the trailing ends of their respective guide grooves 129 and 131 when the assembly is in repose, as indicated in FIG. 10. The remaining parts of this fourth embodiment are the same as the corresponding parts of the third embodiment, as indicated by the reference numerals applied to FIGS. 9 and 10.

Hinge body 3 of this fourth embodiment is attached to base 1 in the same manner as in the third embodiment. More particularly, front stopper 92 of base 1 is received within insertion recess 134 of clip 100, and stopping ridge 135 is engaged in recess 93 formed by said stopper 92. Stopper 95 is received within insertion recess 138 and stopping ridge 139 is received within recess 96 formed in rear stopper 95. This engagement of parts is maintained by the bias supplied by spring 125. Thus, hinge body 3 is separated from base 1 in the same manner as that of the third embodiment. This fourth embodiment has less parts than the third embodiment because guide studs 133 and 137 are integrally formed with the leading and trailing ends of clip 100, i.e., hooking bars 123 and 124 are eliminated. This simplifies assembly of the device and reduces the cost of making it.

Figure 11:
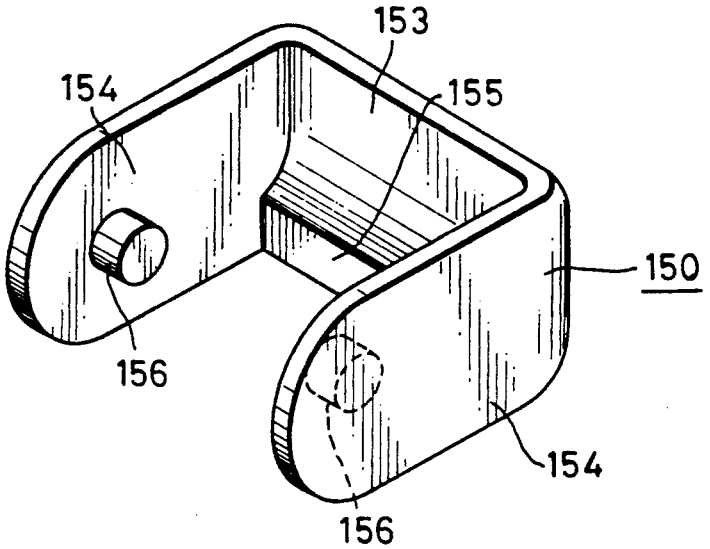
FIG. 11 is a perspective view of a cover member for preventing inadvertent displacement of the clip.
Figure 12:
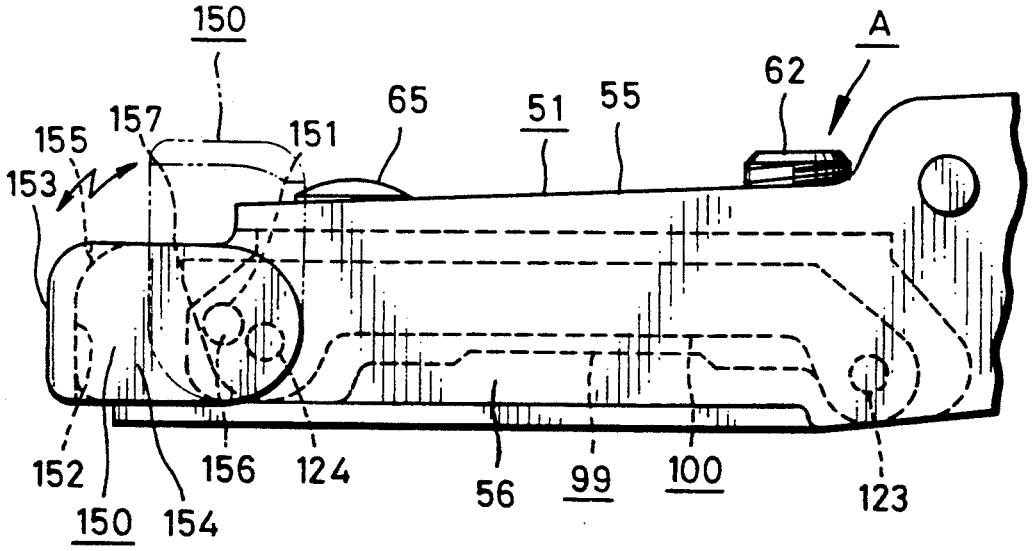
FIG. 12 is a side elevational view of a hinge showing the cover of FIG. 11 positioned to prevent inadvertent separation of the hinge body and base.

The fifth embodiment is shown in FIGS. 11 and 12.

Hinge A of this fifth embodiment has the same structure as body member 51 of hinge body number 3 of the third and fourth embodiments; however, cover 150 is added. Thus, body member 51 includes operating recess 126 formed in the trailing end of top plate 55. Moreover, operating part 157 at the trailing end of clip 100 is in juxtaposition with said operating recess 126, and the trailing end of each side wall 56 projects in trailing relation to operating recess 126. Fitting hole 151 is formed in each side wall 56, near the trailing end thereof, and said fitting holes 151 are in transverse alignment with one another.

Cover 150 has top part 153 of rectangular configuration; it abuts the trailing end 152 of each side wall 56 when cover 150 is in its operative position as depicted in solid lines in FIG. 12. Legs 154 are formed integrally with cover part 153 at its opposite ends and are disposed in parallel relation to one another. Stopper 155 is formed integrally with covering part 153 as best shown in FIG. 11; it slideably engages the respective upper parts of the trailing ends of side walls 56 when cover 150 is in its operative position as depicted in FIG. 12 in solid lines as aforesaid. Legs 154 are transversely spaced apart at a predetermined distance so that they overlie their respective side walls 56 when cover 150 is installed. Inwardly extending studs 156, formed near the respective lowermost ends of legs 154, are rotatably mounted in fitting holes 151 of their associated side walls 56. Accordingly, cover 150 is rotatably mounted to the trailing ends of side walls 56 so that it rotates vertically about studs 156.

When cover 150 is rotated downwardly into the position in solid lines in FIG. 12, after body member 51 of hinge body 3 has been connected through connecting means 2 to base 1, stopper part 155 of covering part 153 is engaged with the respective upper surfaces of the trailing ends of side walls 56, as aforesaid, and covering part 153 engages trailing end 152 of each side wall 56. Thus, covering part 153 covers connector 99 of connecting means 2 and operating portion 157 at the trailing end of clip 100. This prevents accidental forward pushing of operating portion 157 of clip 100 so that the hinge cannot become disassembled inadvertently.

When cover 150 is rotated upwardly around studs 156, as indicated by the phantom lines of FIG. 12, operating part 157 of clip 100 is no longer covered by covering part 153. Thus, body member 51 of hinge body 3 is easily removed from base 1 by pushing said exposed operating portion 157.

Figure 13:
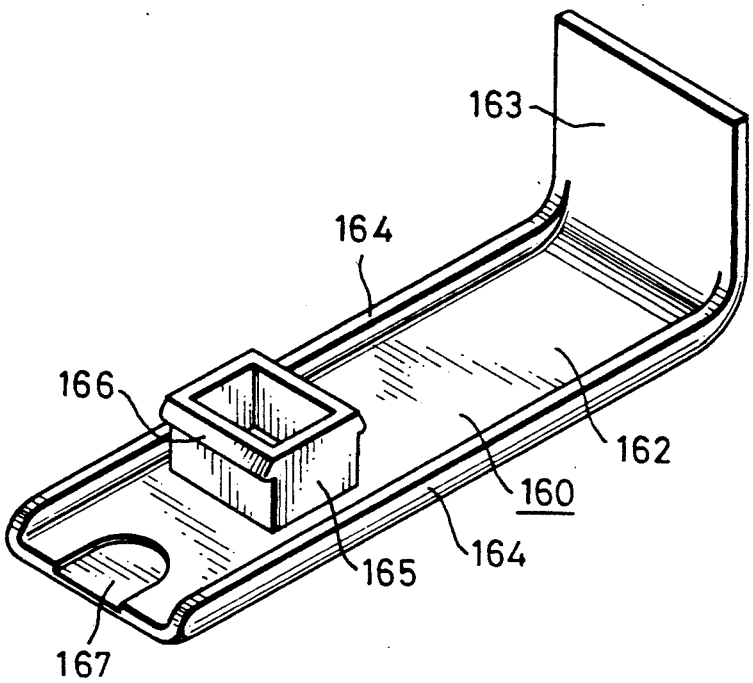
FIG. 13 is a perspective view of a second embodiment of the cover member.
Figure 14:
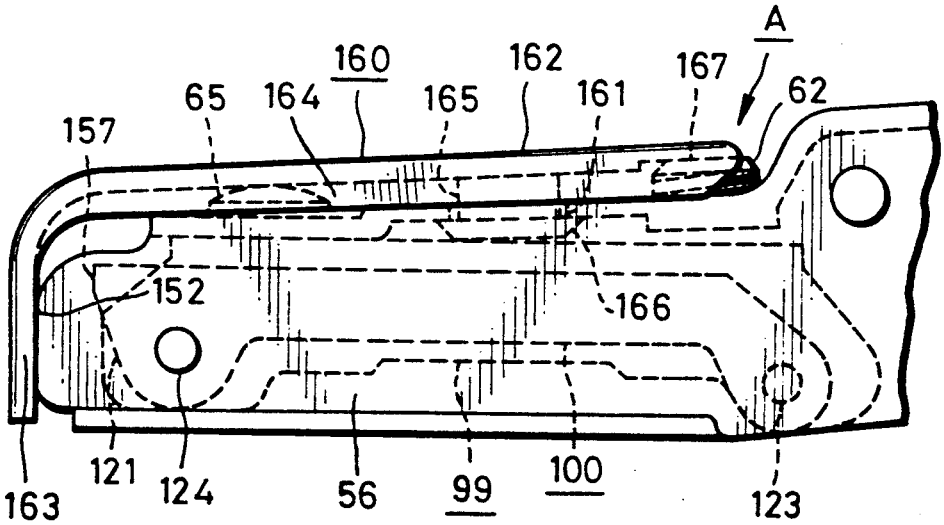
FIG. 14 is a side elevational view of an assembled hinge having the second embodiment of the cover member positioned in association therewith to prevent inadvertent separation of the hinge body and base.

Reference should now be made to FIGS. 13 and 14, wherein the sixth embodiment of the invention is depicted.

Again, the structure of hinge A of this sixth embodiment is the same as the body member 51 of hinge body 3 of the third and fourth embodiments, but cover 160 is added thereto. Thus, body member 51, as in the earlier embodiments, includes tapped hole 57 and the elongated holes 58 respectively at the leading and trailing ends of top wall 55. Moreover, operating recess 126 formed in the trailing end of top wall 55 is provided, operating part 157 of clip 100 being disposed in juxtaposition with operating recess 126. Square hole 161 (FIG. 14) for fitting the hinge is formed in top wall 55 between tapped hole 57 and elongated hole 58.

Cover 160 includes an elongate, narrow overlapping part 162 that is adapted to overlie top wall 55. It further includes covering part 163 of rectangular construction that engages the respective trailing ends 152 of side walls 56. Note that overlapping part 162 and covering part 163 are integrally formed with one another and collectively form an "L" shape.

A ridge 164 that engages top wall 55 is formed along the longitudinal extent of overlapping part 162, at its opposite edges as depicted in FIG. 13. Rectangular box-shaped stopping member 165 that is slideably received within square hole 161 is formed in overlapping part 162, in depending relation thereto. Flange 166 is formed in the free end of stopping member 165; it prevents retraction of stopping member 165 from square hole 161 as shown in FIG. 14. Hooking recess 167 that hookingly engages the top of adjusting screw 62 is formed in the trailing end of overlapping part 162, in the underside thereof.

Thus, after body member 51 of hinge body 3 is connected through connecting means 2 to base 1, when overlapping part 162 of cover 160 is placed into overlying relation to top wall 55 of body member 51, and stopping member 165 is inserted into square hole 161, stopping member 165 is hooked to said square hole 161 by flange 166 as aforesaid. Elongate ridges 164 engage the opposite sides of top wall 55, covering part 163 abuts and overlies the trailing ends 152 of side walls 56, and hooking recess 167 is engaged with the upper part of adjusting screw 62. Accordingly, covering part 163 covers connector 99 of connecting means 2 and operating portion 157 at the trailing end of clip 100, thereby preventing accidental forward pushing of said operating part 157 of clip 100.

Figure 15:
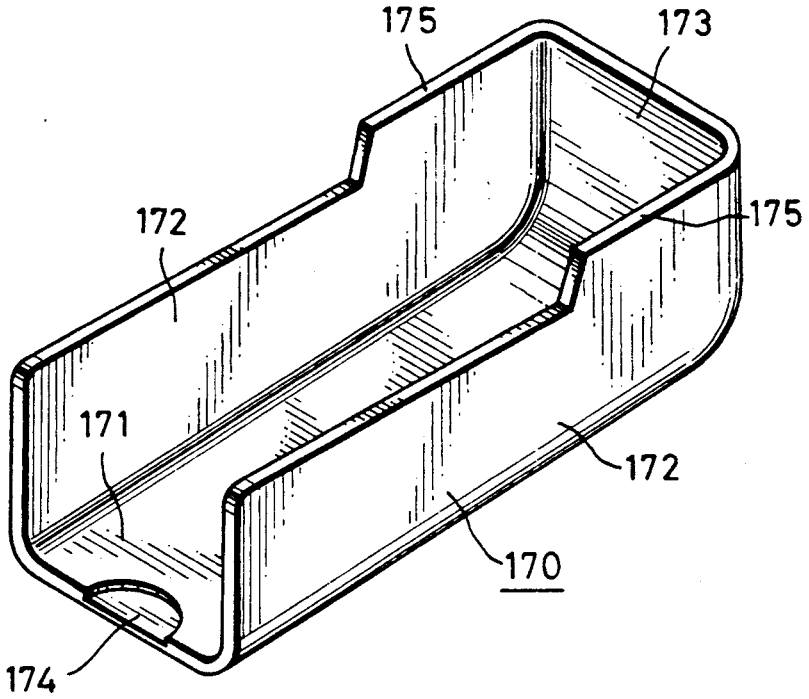
FIG. 15 is a perspective view of a third embodiment of the cover.
Figure 16:
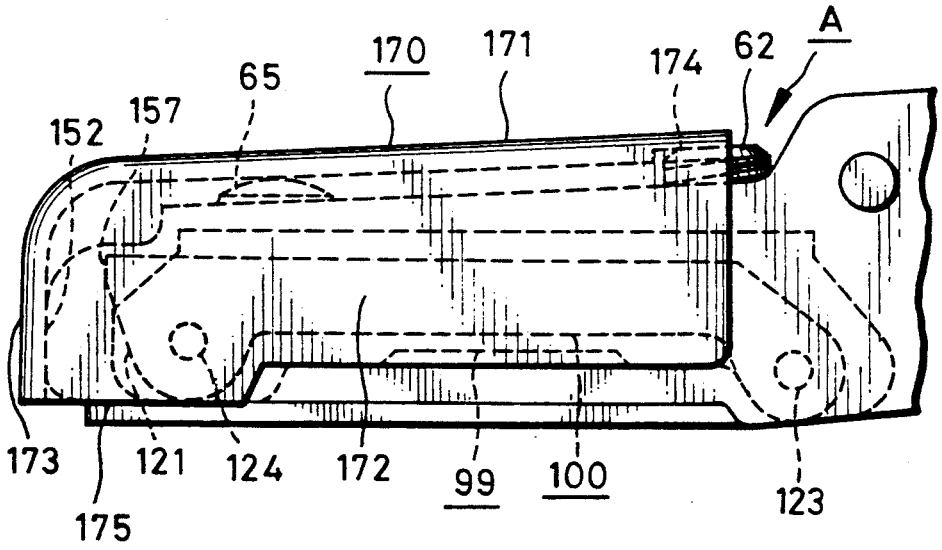
FIG. 16 is a side elevational view of said third embodiment of the cover disposed in protective relation to the hinge member.

The seventh embodiment of the invention is depicted in FIGS. 15 and 16.

Hinge A of this seventh embodiment has the same structure as body member 51 of hinge body 3 of the third and fourth embodiments, with the exception of the addition of cover 170. Body member 51 includes top wall 55 and side walls 56 as in the earlier-described embodiments. Body member 51 is provided with adjusting screw 62 and set screw 65 at the leading and trailing ends of top wall 55, respectively. Moreover, operating recess 126 is formed in the trailing end of top wall 55, and operating portion 157 formed in the trailing end of clip 100 is positioned in juxtaposition with said operating recess 126.

Cover 170 is of monolithic construction as shown in FIG. 15, and includes top wall 171 which overlies top wall 55 when said cover is in position as depicted in FIG. 16. Side walls 172 of cover 170 overlie and elastically engage said side walls 56, i.e., said side Walls 172 are somewhat resilient and are positioned apart from one another by a distance that is slightly less than the distance between the outer surfaces of side walls 56. Cover 170 further includes covering part 173 of generally rectangular construction; part 173 engages the respective trailing ends of side walls 56 when the cover is in position, as indicated in FIG. 16. Hooking recess 174 hooks the uppermost end of adjusting screw 62. Note further that the bottom edges of cover 170 are denoted 175.

Upon connection of body member 51 of hinge body 3 to base through connection means 2, side walls 172 are placed into overlying relation with their associated side walls 56, and top wall 171 of the cover overlies top wall 55 of body member 51 as aforesaid. Hooking recess 174 of top wall 171 engages the top of adjusting screw 62, side walls 172 elastically engage side walls 56, and the lowermost edges 175 of cover 170 abuttingly engage base 1. Covering part 173 therefore engages the trailing end 152 of each side wall 56 as depicted in FIG. 16. Covering part 173 covers connector 99 of connecting means 2 and operating portion 157 at the trailing end of clip 100, thereby preventing accidental forward pushing of operating portion 157 of clip 100.

Covers 150, 160, or 170 may be employed with any of the four embodiments of body member 51 of hinge body 3, i.e., said covers have utility in connection with the first, second, third, and fourth embodiments thereof. When used in connection with the first or second embodiment, said covers will cover operating portion 45 of clip 43, thereby preventing inadvertent forward pushing of operating portion 45.

Although coil springs are shown as the bias means in all embodiments of the novel hinge, it should be understood that other suitable bias means are within the scope of this invention. For example, elastic materials such as rubber, synthetic resins, leaf springs and the like may be used in place of the depicted coil springs.

This invention is clearly new and useful. Moreover, it was not obvious to those of ordinary skill in this art, in view of the prior art when considered as a whole.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, I claim:

1. A hinge having quickly detachable parts, comprising:

a base for mounting to a side panel of an article of furniture;

a base body of predetermined longitudinal extent and of predetermined breadth formed in said base and projecting upwardly therefrom;

a hinge main body;

said hinge main body including a cup part for mounting to a door of an article of furniture and a hinge body part for detachable engagement with said base body, said cup part and said hinge body part being hingedly interconnected to one another;

a connecting means for releasably interconnecting said hinge body part and said base body;

said connecting means including a connector and a clip, said connector and clip being disposed in sliding engagement to one another;

said connector including a top wall and a pair of parallel, transversely spaced apart side walls, said side walls having a first pair of elongate, longitudinally extending guide slots formed in a leading end thereof;

said side walls of said connector overlying side walls of said base body when the hinge is assembled;

said clip having a pair of parallel, transversely spaced apart connecting pieces, and each of said connecting pieces having a bore formed in its leading end;

said clip further including a transversely disposed operating member that interconnects the trailing ends of said connecting pieces;

a transverse hooking bar having its opposite ends slidably disposed in said first pair of elongate guide slots, said opposite ends also being received and retained by said bores formed in the respective leading ends of said connecting pieces;

a bias means for urging said clip and hence said transverse hooking bar rearwardly relative to said connector so that said transverse hooking bar is positioned in a trailing end of said first pair of guide slots when said bias means is in repose;

a stopper formed on said base body, said stopper being provided in the form of an upwardly projecting protuberance positioned near the leading end of the base body, said protuberance defining an overhang means for releasably capturing said transverse hooking bar when said hinge is assembled and when said bias means is in repose;

said overhang means defining a recess thereunder for receiving said transverse hooking bar when the hinge is assembled and when the bias means is in repose;

said overhang means including a downwardly and forwardly inclined upper surface that constrains said transverse hooking bar and hence said clip to displace forwardly with respect to said connector when said is initially pressed against said base body;

said overhang means further including a downwardly and rearwardly inclined lower surface that is positioned below said downwardly and forwardly inclined upper surface so that said transverse hooking bar slidably engages said downwardly and rearwardly inclined lower surface when a continuation of said initial pressing is accomplished, said transverse hooking bar being guided against said downward and rearward sloping lower surface into said recess under the bias of said bias means;

whereby pressing said connector onto said base body results in engagement of said stopper by said transverse hooking bar; and whereby said transverse hooking bar is released from said engagement by pressing forwardly on said clip to overcome the bias of said bias means and to displace said transverse hooking bar forwardly so that it is released from said recess.

2. The hinge of claim 1, further comprising a pair of laterally spaced apart recesses formed in a leading side of said operating member, a pair of fitting pieces formed in a trailing end of said connector top wall, and a pair of laterally spaced apart spring members having their respective trailing ends positioned in said recesses and their respective leading ends disposed in engaged relation to said fitting pieces, said spring members providing said bias means.

3. The hinge of claim 1, further comprising a second pair of guide slots formed in the trailing end of each side wall of said connector and an inwardly projecting guide stud formed in each connecting piece of said clip near its trailing end, said guide studs being slidably received within their associated guide slots of said second pair of guide slots when the hinge is assembled.

4. The hinge of claim 1, further comprising a flat protruding member formed integrally with said base body and which extends forwardly therefrom, a transversely disposed positioning ridge formed in a leading end of said protruding member, a first positioning recess formed in a leading end of each of said connector side walls for abuttingly engaging said transversely disposed positioning ridge when said hinge is assembled, a positioning protrusion formed in each of said base body side walls, about mid-length thereof, and a second positioning recess formed in each of said connector side walls, about mid-length thereof, for receiving said positioning protrusions when the hinge is assembled, said first and second positioning recesses having utility in aligning and holding against movement said connector relative to said base body when the hinge is assembled.

5. The hinge of claim 1, further comprising a cover for preventing inadvertent compression of said bias means, said cover including a top wall, a pair of transversely disposed leg members extending from opposite ends of said top wall, an inwardly extending guide stud formed in each of said leg members near a free end thereof, and a corresponding fitting hole formed in a trailing end of each side wall of said connector so that insertion of said guide studs within their associated fitting holes enables rotational movement of said cover with respect to said clip so that when said cover is rotated into a first position where the top part of said cover overlies said operating member, inadvertent displacement of said operating member is prevented, inadvertent displacement of said operating member is prevented, and so that when said cover is rotated into a second position where it is substantially normal to said clip, said operating member is uncovered and may be displaced.

6. The hinge of claim 5, further comprising a stopper formed integrally with said cover top wall on an underside thereof, said stopper abuttingly engaging the trailing ends of said connector side walls when said cover is rotated into said first position where it prevents displacement of said operating member.

7. The hinge of claim 1, further comprising a cover for preventing inadvertent compression of said bias means, said cover including an elongate top wall adapted to overlie the top wall of said hinge body, a covering part, formed integrally with and disposed normal to said elongate top wall, a shallow hooking recess formed in said elongated top wall at an end thereof opposite from said covering part, said shallow hooking recess for hooking the head of an adjustment screw that adjustably joins together said hinge body and said connector, a ridge formed along the extent of the opposite edges of said elongate top wall for engaging the side walls of said hinge body when said elongate top wall of said cover overlies said hinge body top wall, a square opening formed in the top wall of said hinge body, a complementally formed, box-shaped stopping member, formed in said elongate top wall of said cover, adapted for insertion through said square opening to overlock said cover and said hinge body, said covering part being disposed in covering relation to said operating member to prevent inadvertent displacement of said operating member when said elongate top wall of said cover is disposed in overlying relation to said hinge body top wall, said ridges engaging the side walls of said hinge body and said covering part overlying the trailing ends of said connector side walls when said cover is so disposed to maintain said cover in position.

8. The hinge of claim 1, further comprising a cover for preventing inadvertent compression of said bias means, said cover including an elongate top wall adapted to overlie the top wall of said hinge body, a covering part, formed integrally with and disposed normal to said elongate top wall, a shallow hooking recess formed in said elongated top wall at an end thereof opposite from said covering part, said shallow hooking recess for hooking the head of an adjustment screw that adjustably joins together said hinge body and said connector, a pair of side walls formed integrally with said top wall and said covering part, said side walls being spaced apart from one another by a distance slightly less than the distance between the outer surfaces of the side walls of said hinge body for elastically engaging said side walls of said hinge body when said elongate top wall of said cover overlies said hinge body top wall, said covering part being disposed in covering relation to said operating member to prevent inadvertent displacement of said operating member when said elongate top wall of said cover is disposed in overlying relation to said hinge body top wall, said side walls of said covering part engaging the trailing ends of said connector side walls when said cover is so disposed to maintain said cover in position.

9. A hinge having quickly detachable parts, comprising:

a base for mounting to a side panel of an article of furniture;

a hinge main body;

said hinge main body including a cup part for mounting to a door of an article of furniture and a hinge body part for detachable engagement with said base body, said cup part and said hinge body part being hingedly interconnected to one another;

a connecting means for releasably interconnecting said hinge body part and said base;

said connecting means including a connector and a clip, said connector and clip being disposed in sliding engagement to one another;

said connector including a top wall and a pair of parallel, transversely spaced apart side walls, and each of said side walls having a first elongate, longitudinally extending guide slot formed in a leading end thereof, said guide slots forming a first pair of guide slots and being disposed in transversely spaced apart relation to one another;

said side walls further having a second pair of elongate, transversely spaced apart, longitudinally extending guide slots formed therein about mid-length thereof;

said clip having a pair of parallel, transversely spaced apart connecting pieces, each of said connecting pieces having a first bore formed in its leading end to provide a first pair of transversely spaced apart bores, and each of said connecting pieces having a second bore formed about mid-length thereof to provide a second pair of transversely spaced apart bores;

said clip further including a transversely disposed operating member that interconnects the trailing ends of said connecting pieces;

a first transversely disposed hooking bar having its opposite ends slidably disposed in said first pair of elongate guide slots, said opposite ends also being received and retained by said first pair of bores formed in the respective leading ends of said connecting pieces;

a second transversely disposed hooking bar having its opposite ends slidably disposed in said second pair of elongate guide slots, said opposite ends also being received and retained by said second pair of bores formed in the connecting pieces;

a bias means for urging said clip and hence said first and second transverse hooking bars rearwardly relative to said connector so that said transverse hooking bars are positioned in a trailing end of their associated guide slots when said bias means is in repose;

a first stopper formed on said base, said first stopper being provided in the form of a first upwardly projecting protuberance defining an overhang means for releasably capturing said first transverse hooking bar when said hinge is assembled;

a second stopper formed on said base, said second stopper being provided in the form of a second upwardly projecting protuberance positioned near the trailing end of the base, said second protuberance defining an overhang means for releasably capturing said second transverse hooking bar when said hinge is assembled;

each of said overhang means defining a recess thereunder for receiving its associated transverse hooking bar when the hinge is assembled and when the bias means is in repose;

each of said overhang means including a downwardly and forwardly inclined upper surface that constrains its associated transverse hooking bar and hence said clip to displace forwardly with respect to said connector when said is initially pressed against said base;

each of said overhang means further including a downwardly and rearwardly inclined lower surface that is positioned below said downwardly and forwardly inclined upper surface so that its associated transverse hooking bar slidably engages said downwardly and rearwardly inclined lower surface when a continuation of said initial pressing is accomplished, said first and second transverse hooking bars being guided against said downward and rearward sloping lower surface into said recess under the bias of said bias means;

a flat protruding member formed integrally with said base and which extends forwardly therefrom, a transversely disposed positioning ridge formed in a leading end of said protruding member, a first positioning recess formed in a leading end of each of said connector side walls for abuttingly engaging said transversely disposed positioning ridge when said hinge is assembled, a positioning protrusion formed in each side wall of said first stopper, and a second positioning recess formed in each of said connector side walls, about mid-length thereof, for receiving and positioning protrusions when the hinge is assembled, said first and second positioning recesses having utility in aligning and holding against movement said connector relative to said base when the hinge is assembled;

whereby pressing said connector onto said base results in engagement of said first and second stoppers by said first and second transverse hooking bars; and whereby said first and second transverse hooking bars are released from said engagement by pressing forwardly on said clip to overcome the bias of said bias means and to displace said first and second transverse hooking bars forwardly so that each first and second transverse hooking bar is released from its associated recess.

10. The hinge of claim 9, further comprising a forwardly projecting protuberance formed in a leading side of said operating member, a downwardly extending fitting piece formed integrally with said connector top wall at a trailing end thereof in normal relation thereto, a rearwardly projecting protuberance formed in a trailing side of said fitting piece, and a spring member having its opposite ends engaged by said respective protuberances, said spring member providing said bias means.

11. The hinge of claim 9, further comprising a pair of parallel positioning grooves formed in said flat protruding member, said connector side walls having lowermost edges that are adapted to fit within said positioning grooves when the hinge is assembled to further position and hold said connector to said base when said hinge is assembled.

12. The hinge of claim 9, further comprising a cover for preventing inadvertent compression of said bias means, said cover including a top wall, a pair of transversely disposed leg members extending from opposite ends of said top wall, an inwardly extending guide stud formed in each of said leg members near a free end thereof, and a corresponding fitting hole formed in a trailing end of each side wall of said connector so that insertion of said guide studs within their associated fitting holes enables rotational movement of said cover with respect to said clip so that when said cover is rotated into a first position where the top part of said cover overlies said operating member, inadvertent displacement of said operating member is prevented, and so that when said cover is rotated into a second position where it is substantially normal to said clip, said operating member is uncovered and may be displaced.

13. The hinge of claim 9, further comprising a stopper formed integrally with said cover top wall on an underside thereof, said stopper abuttingly engaging the trailing ends of said connector side walls when said cover is rotated into said first position where it prevents displacement of said operating member.

14. The hinge of claim 9, further comprising a cover for preventing inadvertent compression of said bias means, said cover including an elongate top wall adapted to overlie the top wall of said hinge body, a covering part, formed integrally with and disposed normal to said elongate top wall, a shallow hooking recess formed in said elongated top wall at an end thereof opposite from said covering part, said shallow hooking recess for hooking the head of an adjustment screw that adjustably joins together said hinge body and said connector, a ridge formed along the extent of the opposite edges of said elongate top wall for engaging the side walls of said hinge body when said elongate top wall of said cover overlies said hinge body top wall, a square opening formed in the top wall of said hinge body, a complementally formed, box-shaped stopping member, formed in said elongate top wall of said cover, adapted for insertion through said square opening to overlock said cover and said hinge body, said covering part being disposed in covering relation to said operating member to prevent inadvertent displacement of said operating member when said elongate top wall of said cover is disposed in overlying relation to said hinge body top wall, said ridges engaging the side walls of said hinge body and said covering part overlying the trailing ends of said connector side walls when said cover is so disposed to maintain said cover in position.

15. The hinge of claim 9, further comprising a cover for preventing inadvertent compression of said bias means, said cover including an elongate top wall adapted to overlie the top wall of said hinge body, a covering part, formed integrally with and disposed normal to said elongate top wall, a shallow hooking recess formed in said elongated top wall at an end thereof opposite from said covering part, said shallow hooking recess for hooking the head of an adjustment screw that adjustably joins together said hinge body and said connector, a pair of side walls formed integrally with said top wall and said covering part, said side walls being spaced apart from one another by a distance slightly less than the distance between the outer surfaces of the side walls of said hinge body for elastically engaging said side walls of said hinge body when said elongate top wall of said cover overlies said hinge body top wall, said covering part being disposed in covering relation to said operating member to prevent inadvertent displacement of said operating member when said elongate top wall of said cover is disposed in overlying relation to said hinge body top wall, and said covering part overlying the trailing ends of said connector side walls when said cover is in position.

16. A hinge having quickly detachable parts, comprising:

a base for mounting to a side panel of an article of furniture;

a step of predetermined longitudinal extent and of predetermined breadth formed in said base and projecting upwardly therefrom;

a hinge main body;

said hinge main body including a cup part for mounting to a door of an article of furniture and a body part for detachable engagement with said base, said cup part and said hinge body part being hingedly interconnected to one another;

a connecting means for releasably interconnecting said body part and said base;

said connecting means including a connector and a clip, said connector and clip being disposed in sliding engagement to one another;

said connector including a top wall and a pair of parallel, transversely spaced apart side walls;

an opening formed in said top wall;

a downwardly extending stop wall being disposed at a leading end of said opening;

each of said side walls having a first elongate, longitudinally extending guide slot formed in a leading end thereof, said guide slots forming a first pair of guide slots and being disposed in transversely spaced apart relation to one another;

said side walls further having a second pair of elongate, transversely spaced apart, longitudinally extending guide slots formed therein in a trailing end thereof;

said clip having a top wall and a pair of parallel, transversely spaced apart side walls;

a bias means-receiving opening formed in said clip top wall;

a downwardly extending stop wall being disposed at a trailing end of said bias means-receiving opening;

each of said clip side walls having a first bore formed in its leading end to provide a first pair of transversely spaced apart bores, and each of said clip side walls having a second bore formed in its trailing end to provide a second pair of transversely spaced apart bores;

a first transversely disposed hooking bar having its opposite ends slidably disposed in said first pair of elongate guide slots, said opposite ends also being received and retained by said first pair of bores formed in the respective leading ends of said clip side walls;

a second transversely disposed hooking bar having its opposite ends slidably disposed in said second pair of elongate guide slots, said opposite ends also being received and retained by said second pair of bores formed in the trailing ends of said clip side walls;

a bias means for urging said clip and hence said first and second transverse hooking bars rearwardly relative to said connector so that said transverse hooking bars are positioned in a trailing end of their associated guide slots when said bias means is in repose;

said bias means having a trailing end disposed in abutting relation to said downwardly extending stop wall disposed at the trailing end of said bias means-receiving opening formed in said clip top wall and said bias means having a leading end disposed in abutting relation to said downwardly extending stop wall disposed at the leading end of said opening formed in said connector top wall;

a first stopper formed on said step, said first stopper being provided in the form of a first upwardly projecting protuberance positioned near the leading end of the base, said protuberance having a breadth less than the breadth of said step and defining an overhang means for releasably capturing said first transverse hooking bar when said hinge is assembled;

a second stopper formed on said base, said second stopper being provided in the form of a second upwardly projecting protuberance positioned near the trailing end of the base, said second protuberance having a breadth less than the breadth of said step and defining an overhang means for releasably capturing said second transverse hooking bar when said hinge is assembled;

each of said overhang means defining a recess thereunder for receiving its associated transverse hooking bar when the hinge is assembled and when the bias means is in repose;

each of said overhang means including a downwardly and forwardly inclined upper surface that constrains its associated transverse hooking bar and hence said clip to displace forwardly with respect to said connector when said is initially pressed against said base;

each of said overhang means further including a downwardly and rearwardly inclined lower surface that is positioned below said downwardly and forwardly inclined upper surface so that its associated transverse hooking bar slidably engages said downwardly and rearwardly inclined lower surface when a continuation of said initial pressing is accomplished, said first and second transverse hooking bars being guided against said downward and rearward sloping lower surface into said recess under the bias of said bias means;

a forward curved guide surface formed in said step at a leading end thereof on opposite sides of said first stopper, said clip side walls having a forward lowermost edge adapted to abuttingly and slidably engage their associated forward curved guide surfaces when the hinge is being assembled, and a rearward curved guide surface formed in opposite sides of said step at a trailing end thereof, said clip side walls having a rearward lowermost edge adapted to abuttingly and slidably engage their associated rearward curved guide surfaces when the hinge is being assembled;

whereby pressing said connector onto said base results in engagement of said first and second stoppers by said first and second transverse hooking bars;

whereby said first and second transverse hooking bars are released from said engagement by pressing forwardly on said clip to overcome the bias of said bias means and to displace said first and second transverse hooking bars forwardly so that each first and second transverse hooking bar is released from its associated recess; and whereby the bias means does not lengthen the hinge assembly.

17. The hinge of claim 16, further comprising a cover for preventing inadvertent compression of said bias means, said cover including a top wall, a pair of transversely disposed leg members extending from opposite ends of said top wall, an inwardly extending guide stud formed in each of said leg members near a free end thereof, and a corresponding fitting hole formed in a trailing end of each side wall of said connector so that insertion of said guide studs within their associated fitting holes enables rotational movement of said cover with respect to said clip so that when said cover is rotated into a first position where the top part of said cover overlies said operating member, inadvertent displacement of the trailing end of said clip is prevented, and so that when said cover is rotated into a second position where it is substantially normal to said clip, said trailing end of said clip is uncovered and may be displaced.

18. The hinge of claim 17, further comprising a stopper formed integrally with said cover top wall on an underside thereof, said stopper abuttingly engaging the trailing ends of said connector side walls when said cover is rotated into said first position where it prevents displacement of said clip.

19. The hinge of claim 16, further comprising a cover for preventing inadvertent compression of said bias means, said cover including an elongate top wall adapted to overlie the top wall of said hinge body, a covering part, formed integrally with and disposed normal to said elongate top wall, a shallow hooking recess formed in said elongated top wall at an end thereof opposite from said covering part, said shallow hooking recess for hooking the head of an adjustment screw that adjustably joins together said hinge body and said connector, a ridge formed along the extent of the opposite edges of said elongate top wall for engaging the side walls of said hinge body when said elongate top wall of said cover overlies said hinge body top wall, a square opening formed in the top wall of said hinge body, a complementally formed, box-shaped stopping member, formed in said elongate top wall of said cover, adapted for insertion through said square opening to overlock said cover and said hinge body, said covering part being disposed in covering relation to a trailing end of said clip to prevent inadvertent displacement of said clip when said elongate top wall of said cover is disposed in overlying relation to said hinge body top wall, said ridges engaging the side walls of said hinge body and said covering part overlying the trailing ends of said connector side walls when said cover is so disposed to maintain said cover in position.

20. The hinge of claim 16, further comprising a cover for preventing inadvertent compression of said bias means, said cover including an elongate top wall adapted to overlie the top wall of said hinge body, a covering part, formed integrally with and disposed normal to said elongate top wall, a shallow hooking recess formed in said elongated top wall at an end thereof opposite from said covering part, said shallow hooking recess for hooking the head of an adjustment screw that adjustably joins together said hinge body and said connector, a pair of side walls formed integrally with said top wall and said covering part, said side walls being spaced apart from one another by a distance slightly less than the distance between the outer surfaces of the side walls of said hinge body for elastically engaging said side walls of said hinge body when said elongate top wall of said cover overlies said hinge body top wall, said covering part being disposed in covering relation to a trailing end of said clip to prevent inadvertent displacement of said clip when said elongate top wall of said cover is disposed in overlying relation to said hinge body top wall, said side walls of said covering part engaging the side walls of said hinge body and said covering part overlying the trailing ends of said connector side walls when said cover is so disposed to maintain said cover in position.

21. A hinge having quickly detachable parts, comprising:

a base for mounting to a side panel of an article of furniture;

a step of predetermined longitudinal extent and of predetermined breadth formed in said base and projecting upwardly therefrom;

a hinge main body;

said hinge main body including a cup part for mounting to a door of an article of furniture and a body part for detachable engagement with said base, said cup part and said hinge body part being hingedly interconnected to one another;

a connecting means for releasably interconnecting said body part and said base;

said connecting means including a connector and a clip, said connector and clip being disposed in sliding engagement to one another;

said connector including a top wall and a pair of parallel, transversely spaced apart side walls;

an opening formed in said top wall;

a downwardly extending stop wall being disposed at a leading end of said opening;

each of said side walls having a first elongate, longitudinally extending guide slot formed in a leading end thereof, said guide slots forming a first pair of guide slots and being disposed in transversely spaced apart relation to one another;

said side walls further having a second pair of elongate, transversely spaced apart, longitudinally extending guide slots formed therein in a trailing end thereof;

said clip having a top wall and a pair of parallel, transversely spaced apart side walls;

a bias means-receiving opening formed in said clip top wall;

a downwardly extending stop wall being disposed at a trailing end of said bias means-receiving opening;

each of said clip side walls having a first laterally outwardly extending guide stud formed in its leading end to provide a first pair of guide studs, and each of said clip side walls having a second laterally extending guide stud formed in its trailing end to provide a second pair of guide studs;

each guide stud of said first pair of guide studs being slidably disposed in an associated guide slot of said first pair of elongate guide slots;

each guide stud of said second pair of guide studs being slidably disposed in an associated guide slot of said second pair of elongate guide slots;

a bias means for urging said clip and hence said first and second pair of guide studs rearwardly relative to said connector so that said first and second pair of guide studs are positioned in a trailing end of their associated guide slots when said bias means is in repose;

said bias means having a trailing end disposed in abutting relation to said downwardly extending stop wall disposed at the trailing end of said bias means-receiving opening formed in said clip top wall and said bias means having a leading end disposed in abutting relation to said downwardly extending stop wall disposed at the leading end of said opening formed in said connector top wall;

a first stopper formed on said step, said first stopper being provided in the form of a first upwardly projecting protuberance positioned near the leading end of the base, said protuberance having a breadth less than the breadth of said step and defining an overhang means for releasably capturing said first transverse hooking bar when said hinge is assembled;

a second stopper formed on said base, said second stopper being provided in the form of a second upwardly projecting protuberance positioned near the trailing end of the base, said second protuberance defining an overhang means for releasably capturing said second pair of guide studs when said hinge is assembled;

each of said overhang means defining a recess thereunder for receiving its associated guide studs when the hinge is assembled and when the bias means is in repose;

each of said overhang means including a downwardly and forwardly inclined upper surface that constrains its associated guide studs and hence said clip to displace forwardly with respect to said connector when said connector is initially pressed against said base;

each of said overhang means further including a downwardly and rearwardly inclined lower surface that is positioned below said downwardly and forwardly inclined upper surface so that its associated guide studs slidably engages said downwardly and rearwardly inclined lower surface when a continuation of said initial pressing is accomplished, said first and second pair of guide studs being guided against said downward and rearward sloping lower surface into said recess under the bias of said bias means;

a forward curved guide surface formed in said step at a leading end thereof on opposite sides of said first stopper, said clip side walls having a forward lowermost edge adapted to abuttingly and slidably engage their associated forward curved guide surfaces when the hinge is being assembled, and a rearward curved guide surface formed in opposite sides of said step at a trailing end thereof, said clip side walls having a rearward lowermost edge adapted to abuttingly and slidably engage their associated rearward curved guide surfaces when the hinge is being assembled;

whereby pressing said connector onto said base results in engagement of said first and second stoppers by said first and second pairs of guide studs;

whereby said first and second pairs of guide studs are released from said engagement by pressing forwardly on said a trailing end of said clip to overcome the bias of said bias means and to displace said first and second pairs of guide studs forwardly so that each guide stud of said first and second pairs of guide studs is released from its associated recess; and whereby the bias means does not lengthen the hinge assembly.

22. The hinge of claim 21, further comprising a cover for preventing inadvertent compression of said bias means, said cover including a top wall, a pair of transversely disposed leg members extending from opposite ends of said top wall, an inwardly extending guide stud formed in each of said leg members near a free end thereof, and a corresponding fitting hole formed in a trailing end of each side wall of said connector so that insertion of said guide studs within their associated fitting holes enables rotational movement of said cover with respect to said clip so that when said cover is rotated into a first position where the top part of said cover overlies the trailing end of said clip, inadvertent displacement of said clip is prevented, and so that when said cover is rotated into a second position where it is substantially normal to said clip, said trailing end of said clip is uncovered and may be displaced.

23. The hinge of claim 22, further comprising a stopper formed integrally with said cover top wall on an underside thereof, said stopper abuttingly engaging the trailing ends of said connector side walls when said cover is rotated into said first position where it prevents displacement of said clip.

24. The hinge of claim 21, further comprising a cover for preventing inadvertent compression of said bias means, said cover including an elongate top wall adapted to overlie the top wall of said hinge body, a covering part, formed integrally with and disposed normal to said elongate top wall, a shallow hooking recess formed in said elongated top wall at an end thereof opposite from said covering part, said shallow hooking recess for hooking the head of an adjustment screw that adjustably joins together said hinge body and said connector, a ridge formed along the extent of the opposite edges of said elongate top wall for engaging the side walls of said hinge body when said elongate top wall of said cover overlies said hinge body top wall, a square opening formed in the top wall of said hinge body, a complementally formed, box-shaped stopping member, formed in said elongate top wall of said cover, adapted for insertion through said square opening to overlock said cover and said hinge body, said covering part being disposed in covering relation to a trailing end of said clip to prevent inadvertent displacement of said clip when said elongate top wall of said cover is disposed in overlying relation to said hinge body top wall, said ridges engaging the side walls of said hinge body and said covering part overlying the trailing ends of said connector side walls when said cover is so disposed to maintain said cover in position.

25. The hinge of claim 21, further comprising a cover for preventing inadvertent compression of said bias means, said cover including an elongate top wall adapted to overlie the top wall of said hinge body, a covering part, formed integrally with and disposed normal to said elongate top wall, a shallow hooking recess formed in said elongated top wall at an end thereof opposite from said covering part, said shallow hooking recess for hooking the head of an adjustment screw that adjustably joins together said hinge body and said connector, a pair of side walls formed integrally with said top wall and said covering part, said side walls being spaced apart from one another by a distance slightly less than the distance between the outer surfaces of the side walls of said hinge body for elastically engaging said side walls of said hinge body when said elongate top wall of said cover overlies said hinge body top wall, said covering part being disposed in covering relation to a trailing end of said clip to prevent inadvertent displacement of said clip when said elongate top wall of said cover is disposed in overlying relation to said hinge body top wall, said side walls of said covering part engaging the side walls of said hinge body and said covering part overlying the trailing ends of said connector side walls when said cover is so disposed to maintain said cover in position.

* * * * *